US010178723B2

(12) United States Patent
van de Ven

(10) Patent No.: US 10,178,723 B2
(45) Date of Patent: Jan. 8, 2019

(54) SYSTEMS AND METHODS FOR CONTROLLING SOLID STATE LIGHTING DEVICES AND LIGHTING APPARATUS INCORPORATING SUCH SYSTEMS AND/OR METHODS

(75) Inventor: Antony P. van de Ven, Sai Kung (HK)

(73) Assignee: Cree, Inc., Durham, NC (US)

( * ) Notice: Subject to any disclaimer, the term of this patent is extended or adjusted under 35 U.S.C. 154(b) by 1877 days.

(21) Appl. No.: 13/152,640

(22) Filed: Jun. 3, 2011

(65) Prior Publication Data

US 2012/0306375 A1 Dec. 6, 2012

(51) Int. Cl.
*H05B 37/02* (2006.01)
*H05B 33/08* (2006.01)

(52) U.S. Cl.
CPC ..... *H05B 33/083* (2013.01); *H05B 33/0863* (2013.01)

(58) Field of Classification Search
CPC ..... F21K 9/52; H05B 33/0869
USPC ..... 362/231, 346
See application file for complete search history.

(56) References Cited

U.S. PATENT DOCUMENTS 4,743,897 A * 5/1988 Perez ..... 345/212
4,939,426 A 7/1990 Menard et al.
5,334,916 A 8/1994 Noguchi
5,384,519 A * 1/1995 Gotoh ..... 315/324
5,521,708 A * 5/1996 Beretta ..... 356/402
5,847,340 A 12/1998 Godesa
5,929,568 A 7/1999 Eggers
6,385,226 B2 5/2002 McMinn et al.
6,441,558 B1 8/2002 Muthu et al.
6,498,440 B2 12/2002 Stam et al.
6,617,795 B2 9/2003 Bruning
6,636,003 B2 10/2003 Rahm et al.
6,697,130 B2 2/2004 Weindorf et al.
6,753,661 B2 6/2004 Muthu et al.
6,781,329 B2 * 8/2004 Mueller et al. ..... 315/297
6,788,011 B2 9/2004 Mueller et al.
6,864,641 B2 3/2005 Dygert
6,885,035 B2 4/2005 Bhat et al.
(Continued)

FOREIGN PATENT DOCUMENTS

CN 101821544 A 9/2010
CN 101889475 A 11/2010
(Continued)

OTHER PUBLICATIONS

Hardware Zonbe News 'Agilent Technologies introduces breaktrhough flat-panel TV illumination system that delivers 25 percent more brilliant colors', Jan. 7, 2005.*
(Continued)

*Primary Examiner* — Seokjin Kim
(74) *Attorney, Agent, or Firm* — Myers Bigel, P.A.

(57) ABSTRACT

A lighting apparatus includes at least two sets of light-emitting devices with overlapping spectra and different chromaticities, such as two sets of blue-shifted yellow (BSY) LEDs producing outputs with different yellow content. The devices may be selectively controlled, e.g., by using selective current bypass circuits, to provide a desired color temperature or other visual performance in response to a dimming control input such that, for example, a light output approximating that of an incandescent lamp may be achieved.

33 Claims, 16 Drawing Sheets

(56) References Cited

U.S. PATENT DOCUMENTS 6,897,624 B2* 5/2005 Lys et al. ..... 315/297
6,998,594 B2 2/2006 Gaines et al.
7,038,399 B2 5/2006 Lys et al.
7,067,995 B2 6/2006 Gunter et al.
7,091,874 B2 8/2006 Smithson
7,161,313 B2* 1/2007 Piepgras et al. ..... 315/318
7,186,003 B2 3/2007 Dowling et al.
7,213,940 B1 5/2007 Van de Ven et al.
7,233,831 B2 6/2007 Blackwell
7,238,898 B1 7/2007 Czarnecki
7,245,089 B2 7/2007 Yang
7,352,138 B2 4/2008 Lys et al.
7,358,679 B2 4/2008 Lys et al.
7,385,359 B2* 6/2008 Dowling et al. ..... 315/292
7,432,668 B2 10/2008 Zwanenburg et al.
7,515,128 B2 4/2009 Dowling
7,772,757 B2 8/2010 Kane et al.
7,808,189 B2 10/2010 Hollnberger et al.
7,812,553 B2 10/2010 Kang et al.
7,821,194 B2 10/2010 Negley et al.
8,044,612 B2 10/2011 Prendergast et al.
8,174,212 B2 5/2012 Tziony et al.
8,212,275 B2 7/2012 Yamada
8,278,846 B2 10/2012 Roberts et al.
8,299,715 B2 10/2012 Philippbar et al.
8,333,631 B2 12/2012 Emerson et al.
8,405,318 B2 3/2013 Hatakenaka et al.
8,471,495 B2 6/2013 Muguruma et al.
8,556,438 B2 10/2013 McKenzie et al.
8,593,481 B2 11/2013 Morgenbrod
8,664,892 B2 3/2014 Radermacher
8,937,557 B2 1/2015 Loveland et al.
9,192,013 B1 11/2015 van de Ven et al.
2001/0032985 A1 10/2001 Bhat et al.
2002/0047624 A1 4/2002 Stam et al.
2004/0105261 A1 6/2004 Ducharme et al.
2004/0233145 A1* 11/2004 Chiang ..... 345/82
2004/0245946 A1 12/2004 Halter
2005/0047134 A1* 3/2005 Mueller et al. ..... 362/231
2005/0122065 A1* 6/2005 Young ..... 315/294
2005/0127381 A1* 6/2005 Vitta et al. ..... 257/88
2005/0162100 A1 7/2005 Romano et al.
2005/0243022 A1* 11/2005 Negru ..... 345/46
2005/0280376 A1 12/2005 Hamidian et al.
2006/0016960 A1 1/2006 Morgan et al.
2006/0076908 A1 4/2006 Morgan et al.
2006/0081773 A1* 4/2006 Rains et al. ..... 250/228
2006/0152172 A9 7/2006 Mueller et al.
2006/0226956 A1 10/2006 Young et al.
2006/0273331 A1 12/2006 Lim et al.
2007/0040512 A1 2/2007 Jungwirth et al.
2007/0051883 A1* 3/2007 Rains et al. ..... 250/228
2007/0139920 A1 6/2007 Van De Ven et al.
2007/0170447 A1 7/2007 Negley et al.
2007/0235751 A1 10/2007 Radkov et al.
2007/0247089 A1 10/2007 Summerland
2007/0263393 A1 11/2007 Van De Ven
2007/0267983 A1* 11/2007 Van De Ven et al. ..... 315/294
2007/0273299 A1 11/2007 Miskin et al.
2008/0001547 A1 1/2008 Negru
2008/0037257 A1 2/2008 Bolta
2008/0043464 A1* 2/2008 Ashdown ..... 362/231
2008/0062070 A1 3/2008 De Oto et al.
2008/0116818 A1 5/2008 Shteynberg et al.
2008/0136331 A1 6/2008 Schmeikal
2008/0179602 A1* 7/2008 Negley et al. ..... 257/88
2008/0215279 A1 9/2008 Salsbury et al.
2008/0304260 A1 12/2008 van de Ven et al.
2009/0079362 A1 3/2009 Shteynberg et al.
2009/0160363 A1* 6/2009 Negley ..... H05B 33/086 315/294
2009/0184616 A1* 7/2009 Van De Ven ..... H05B 33/086 313/1
2009/0189529 A1* 7/2009 Negley et al. ..... 315/122
2009/0206758 A1 8/2009 Kobilke
2009/0243509 A1 10/2009 Barnett et al.
2010/0001648 A1 1/2010 De Clerq et al.
2010/0002440 A1* 1/2010 Negley et al. ..... 362/249.14
2010/0072903 A1 3/2010 Blaut et al.
2010/0102119 A1* 4/2010 Gustin et al. ..... 235/379
2010/0102199 A1* 4/2010 Negley et al. ..... 250/201.1
2010/0103660 A1* 4/2010 van de Ven et al. ..... 362/231
2010/0109550 A1* 5/2010 Huda ..... H05B 33/0818 315/287
2010/0109570 A1 5/2010 Weaver
2010/0127282 A1 5/2010 Harbers et al.
2010/0127283 A1* 5/2010 van de Ven et al. ..... 257/89
2010/0134018 A1* 6/2010 Tziony et al. ..... 315/122
2010/0141159 A1 6/2010 Shiu et al.
2010/0171444 A1 7/2010 Bennette
2010/0244707 A1 9/2010 Gaines et al.
2010/0259182 A1 10/2010 Man et al.
2010/0277907 A1 11/2010 Phipps et al.
2010/0308738 A1 12/2010 Shteynberg et al.
2010/0308739 A1* 12/2010 Shteynberg ..... H05B 33/083 315/193
2011/0037413 A1 2/2011 Negley et al.
2011/0062872 A1 3/2011 Jin et al.
2011/0068696 A1 3/2011 van de Ven et al.
2011/0068701 A1 3/2011 van de Ven et al.
2011/0068702 A1 3/2011 van de Ven et al.
2011/0084614 A1 4/2011 Eisele et al.
2011/0115407 A1 5/2011 Wibben et al.
2011/0115467 A1 5/2011 Wibben et al.
2011/0182065 A1 7/2011 Negley et al.
2011/0199003 A1* 8/2011 Muguruma ..... H05B 33/0824 315/122
2011/0210674 A1 9/2011 Melanson
2011/0210678 A1 9/2011 Grajcar
2011/0254525 A1 10/2011 Gaknoki et al.
2012/0104953 A1 5/2012 Chobot
2012/0176826 A1 7/2012 Lazar
2013/0002167 A1 1/2013 Van de Ven
2013/0026923 A1 1/2013 Athalye et al.
2013/0069561 A1 3/2013 Melanson et al.
2013/0207559 A1 8/2013 Ferrier
2014/0159584 A1* 6/2014 Grajcar ..... H05B 33/0809 315/122
2014/0210362 A1* 7/2014 Shin ..... H05B 33/083 315/186
2016/0066381 A1 3/2016 Despesse

FOREIGN PATENT DOCUMENTS

JP 2003-273404 A 9/2003
JP 2009-049010 A 3/2009
KR 10-2011-0028204 A 3/2011
WO WO 0247438 A2 6/2002
WO WO 03/096761 * 11/2003 ..... H05B 41/00
WO WO 2003/096761 * 11/2003 ..... H05B 41/00
WO WO 2008/052330 A1 5/2008
WO WO 2008/129485 A1 10/2008
WO WO 2009/049019 * 4/2009 ..... F21K 7/00
WO WO 2010/012999 2/2010
WO WO 2011/053873 A1 5/2011

OTHER PUBLICATIONS

Notification of the First Office Action, CN 201280034828.8, dated Jan. 5, 2015, 9 pages.

Notification of Transmittal of the International Search Report and the Written Opinion of the International Searching Authority, or the Declaration, in corresponding PCT Application No. PCT/2014/68534, dated Mar. 4, 2015 (15 pages).

Chinese First Office Action Corresponding to Chinese Patent Application No. 201280062008.X; dated Jul. 6, 2015; Foreign Text, 6 Pages, English Translation Thereof, 7 Pages.

European Search Report Corresponding to European Patent Application No. 12 79 2795; dated Nov. 11, 2015; 7 Pages.

Extended European Search Report for European Patent Application No. 12793449.5; dated Jul. 31, 2015; 10 Pages.

(56) References Cited

OTHER PUBLICATIONS

Japanese Final Rejection Corresponding to Japanese Patent Application No. 2014-513696; dated Oct. 14, 2015; 2 Pages.
Supplementary European Search Report Corresponding to European Patent Application No. 12 85 0396; dated Jun. 21, 2016; 6 Pages.
Author: James Frederick Lazar, Title: U.S. Utility provisional patent application for source and multiple loads regulator U.S. Appl. No. 61/431,435, filed Jan. 11, 2011.
Author: James Frederick Lazar, Title: U.S. Utility provisional patent application for source and multiple loads regulator U.S. Appl. No. 61/431,435, filed Jan. 11, 2011 (Drawings).
European Search Report Corresponding to Application No. 12 85 0396; dated Nov. 4, 2016; 11 Pages.
International Search Report Corresponding to International Application No. PCT/US2012/040189; dated Aug. 20, 2012; 15 Pages.
Rensselaer Polytechnic Institute, "What is color consistency?". NLPIP, Lighting Research Center, vol. 8, Issue 1, Oct. 2004, Retrieved from http://www.lrc.rpi.edu/programs/nlpip/lightinganswers/lightsources/whatisColorConsistency.asp.
International Search Report Corresponding to International Application No. PCT/US2012/064434; dated Jan. 25, 2013; 11 Pages.
Sutardja, P., "Design for High Quality and Low Cost SSL with Power Factor Correction", Marvell Semiconductor Inc. Jul. 2011. 16 pages.
International Search Report Corresponding to International Application No. PCT/US2012/039984; dated Nov. 30, 2012; 10 Pages.

* cited by examiner

SYSTEMS AND METHODS FOR CONTROLLING SOLID STATE LIGHTING DEVICES AND LIGHTING APPARATUS INCORPORATING SUCH SYSTEMS AND/OR METHODS

FIELD OF THE INVENTION

The present invention relates to lighting apparatus and methods and, more particularly, to solid state lighting apparatus and methods.

BACKGROUND

Solid state lighting arrays are used for a number of lighting applications. For example, solid state lighting panels including arrays of solid state light emitting devices have been used as direct illumination sources, for example, in architectural and/or accent lighting. A solid state light emitting device may include, for example, a packaged light emitting device including one or more light emitting diodes (LEDs), which may include inorganic LEDs, which may include semiconductor layers forming p-n junctions and/or organic LEDs (OLEDs), which may include organic light emission layers.

Visible light may include light having many different wavelengths. The apparent color of visible light can be illustrated with reference to a two dimensional chromaticity diagram, such as the 1931 International Conference on Illumination (CIE) Chromaticity Diagram illustrated in FIG. 1, and the 1976 CIE u'v' Chromaticity Diagram, which is similar to the 1931 Diagram but is modified such that similar distances on the 1976 u'v' CIE Chromaticity Diagram represent similar perceived differences in color. These diagrams provide useful reference for defining colors as weighted sums of colors.

In the 1976 CIE Chromaticity Diagram, chromaticity values are plotted using scaled u- and v-parameters which take into account differences in human visual perception. That is, the human visual system is more responsive to certain wavelengths than others. For example, the human visual system is more responsive to green light than red light. The 1976 CIE-u'v' Chromaticity Diagram is scaled such that the mathematical distance from one chromaticity point to another chromaticity point on the diagram is proportional to the difference in color perceived by a human observer between the two chromaticity points. A chromaticity diagram in which the mathematical distance from one chromaticity point to another chromaticity point on the diagram is proportional to the difference in color perceived by a human observer between the two chromaticity points may be referred to as a perceptual chromaticity space. In contrast, in a non-perceptual chromaticity diagram, such as the 1931 CIE Chromaticity Diagram, two colors that are not distinguishably different may be located farther apart on the graph than two colors that are distinguishably different.

As shown in FIG. 1, colors (represented by shades of grey in the figure) on a 1931 CIE Chromaticity Diagram are defined by x and y coordinates (i.e., chromaticity coordinates, or color points) that fall within a generally U-shaped area. Colors on or near the outside of the area are saturated colors composed of light having a single wavelength, or a very small wavelength distribution. Colors on the interior of the area are unsaturated colors that are composed of a mixture of different wavelengths. White light, which can be a mixture of many different wavelengths, is generally found near the middle of the diagram, in the region labeled 100 in FIG. 1. There are many different hues of light that may be considered "white," as evidenced by the size of the region 100. For example, some "white" light, such as light generated by sodium vapor lighting devices, may appear yellowish in color, while other "white" light, such as light generated by some fluorescent lighting devices, may appear more bluish in color.

Light that generally appears green is plotted in the regions 101, 102 and 103 that are above the white region 100, while light below the white region 100 generally appears pink, purple or magenta. For example, light plotted in regions 104 and 105 of FIG. 1 generally appears magenta (i.e., red-purple or purplish red).

It is further known that a binary combination of light from two different light sources may appear to have a different color than either of the two constituent colors. The color of the combined light may depend on the relative intensities of the two light sources. For example, light emitted by a combination of a blue source and a red source may appear purple or magenta to an observer. Similarly, light emitted by a combination of a blue source and a yellow source may appear white to an observer.

Also illustrated in FIG. 1 is the Planckian locus 106, which corresponds to the location of color points of light emitted by a black-body radiator that is heated to various temperatures. In particular, FIG. 1 includes temperature listings along the Planckian locus. These temperature listings show the color path of light emitted by a black-body radiator that is heated to such temperatures. As a heated object becomes incandescent, it first glows reddish, then yellowish, then white, and finally bluish, as the wavelength associated with the peak radiation of the black-body radiator becomes progressively shorter with increased temperature. Illuminants which produce light which is on or near the Planckian locus can thus be described in terms of their correlated color temperature (CCT).

The chromaticity of a particular light source may be referred to as the "color point" of the source. For a white light source, the chromaticity may be referred to as the "white point" of the source. As noted above, the white point of a white light source may fall along the Planckian locus. Accordingly, a white point may be identified by a correlated color temperature (CCT) of the light source. White light typically has a CCT of between about 2000 K and 10000 K. White light with a CCT of 3000 may appear yellowish in color, while light with a CCT of 8000 K may appear more bluish in color. Color coordinates that lie on or near the Planckian locus at a color temperature between about 2500 K and 8000 K may yield pleasing white light to a human observer.

"White" light also includes light that is near, but not directly on the Planckian locus. A Macadam ellipse can be used on a 1931 CIE Chromaticity Diagram to identify color points that are so closely related that they appear the same, or substantially similar, to a human observer. A Macadam ellipse is a closed region around a center point in a two-dimensional chromaticity space, such as the 1931 CIE Chromaticity Diagram, that encompasses all points that are visually indistinguishable from the center point. A seven-step Macadam ellipse captures points that are indistinguishable to an ordinary observer within seven standard deviations, a ten step Macadam ellipse captures points that are indistinguishable to an ordinary observer within ten standard deviations, and so on. Accordingly, light having a color point that is within about a ten step Macadam ellipse of a point on the Planckian locus may be considered to have a substantially similar color as the point on the Planckian locus.

The ability of a light source to accurately reproduce color in illuminated objects is typically characterized using the color rendering index (CRI). In particular, CRI is a relative measurement of how the color rendering properties of an illumination system compare to those of a reference illuminator, with a reference illuminator for a CCT of less than 5000K being a black-body radiator. For CCT of 5000K and above, the reference illuminator is a spectrum defined by the CIE which is similar to the spectrum of sunlight at the earth's surface. The CRI equals 100 if the color coordinates of a set of test colors being illuminated by the illumination system are the same as the coordinates of the same test colors being irradiated by the reference illuminator. Daylight has the highest CRI (of 100), with incandescent bulbs being relatively close (about 95), and fluorescent lighting being less accurate (70-85).

Generally speaking, incandescent bulbs tend to produce more natural-appearing illumination than other types of conventional lighting devices. In particular, incandescent bulbs typically go from a color temperature of about 2700K at full brightness to a color temperature of about 2000 k at 5% brightness and to a color temperature of about 1800K at about 1% brightness. This compares favorably with daylight, which varies from about 6500K at midday to about 2500 k at sunrise and sunset. Research indicates that people tend to prefer warmer color temperatures at low brightness levels and in intimate settings. U.S. Pat. No. 7,213,940 to Van De Ven et al. describes a lighting device using LEDs that can produce warm white light by combining the light from unsaturated yellow (blue-shifted yellow (BSY) LEDs and saturated red LEDs.

In illumination applications, it is often desirable to provide a lighting source that generates a light with a color behavior that approximates the behavior of incandescent lighting. LED-lighting units have been proposed that may be coupled to an AC dimmer circuit and approximate the lighting variation of a conventional incandescent light as the dimmer circuit increases or decreases the brightness of the generated light, as described in U.S. Pat. No. 7,038,399 to Lys et al.

One difficulty with solid state lighting systems including multiple solid state devices is that the manufacturing process for LEDs typically results in variations between individual LEDs. This variation is typically accounted for by binning, or grouping, the LEDs based on brightness, and/or color point, and selecting only LEDs having predetermined characteristics for inclusion in a solid state lighting system. LED lighting devices may utilize one bin of LEDs, or combine matched sets of LEDs from different bins, to achieve repeatable color points for the combined output of the LEDs.

One technique to tune the color point of a lighting fixture is described in commonly assigned United States Patent Publication No. 2009/0160363, the disclosure of which is incorporated herein by reference. The '363 application describes a system in which phosphor converted LEDs and red LEDs are combined to provide white light. The ratio of the various mixed colors of the LEDs is set at the time of manufacture by measuring the output of the light and then adjusting string currents to reach a desired color point. The current levels that achieve the desired color point are then fixed for the particular lighting device. LED lighting systems employing feedback to obtain a desired color point are described in U.S. Publication Nos. 2007/0115662 and 2007/0115228 and the disclosures of which are incorporated herein by reference.

SUMMARY

Some embodiments provide a lighting apparatus including a string of serially-connected light-emitting diodes (LEDs) coupled between first and second terminals. The string includes a first set of LEDs having a first chromaticity and a second set of LEDs having a second chromaticity different from the first chromaticity. The apparatus further includes a control circuit operatively coupled to the string and configured to vary a color temperature produced by the string responsive to a variation in a total current passing between the first and second terminals. In some embodiments, the control circuit is configured to control the total current responsive to a dimmer control input signal.

In some embodiments, the control circuit is configured to differentially vary current passing through the first and second sets of LEDs responsive to the total current such that the color temperature varies as the total current varies. The control circuit may include a bypass circuit configured to differentially bypass current around the first set of LEDs with respect to the second set of LEDs responsive to the total current such that the color temperature varies as the total current varies. The bypass circuit may be configured to differentially bypass current around the first set of LEDs with respect to the second set of LEDs responsive to the total current such that the color temperature decreases as the total current decreases. The bypass circuit may include, for example, at least one resistor coupled in parallel with at least one LED of the first set of LEDs. In further embodiments, the bypass circuit may include a variable resistance circuit and/or a switching circuit.

In some embodiments, the first set of LEDs includes a first set of blue-shifted yellow (BSY) LEDs and the second set of LEDs includes a second set of BSY LEDs. The string may further include a set of red LEDs coupled in series with the first and second sets of BSY LEDs.

In some embodiments, the control circuit may be configured to conform the color temperature to the Planckian locus. For example, the control circuit may be configured to conform the color temperature to within at least a 10 step MacAdam ellipse of the Planckian locus.

In further embodiments, the control circuit may be configured to cause a color temperature produced by the plurality of LEDs to vary in response to the total current over a range from about 6500 K to about 1500 K while maintaining a color rendering index (CRI) greater than about 80%. For example, the control circuit and the plurality of light-emitting devices may be configured to maintain a CRI greater than about 90% for brightness levels between a maximum brightness level and about 5% of the maximum brightness level.

In additional embodiments, the control circuit may be configured to provide a substantially fixed color temperature over a first range of the total current and to conform the color temperature to the Planckian locus over a second range of the total current. The first range of total current may correspond to a range of brightness levels between a maximum brightness level and about 5% of the maximum brightness level.

Additional embodiments of the inventive subject matter provide a lighting apparatus including a plurality of light-emitting devices including at least one red light-emitting device, at least one BSY light-emitting device having a first BSY output and at least one BSY light-emitting device having a second BSY output with a greater yellow or green content than the first BSY output. The apparatus further includes a control circuit operatively coupled to the plurality of light-emitting devices and configured to cause a color temperature produced by the plurality of light-emitting devices to vary substantially in conformance with the Planckian locus in response to a dimming control input. The control circuit may be configured, for example, to conform the color temperature to within at least a 10 step MacAdam ellipse of the Planckian locus.

In some embodiments, the control circuit may be configured to preferentially decrease a current through the at least one light BSY light-emitting device having the first BSY output in comparison to a current through the at least one BSY light-emitting device having the second BSY output responsive to the dimming control input commanding a decrease in brightness. The control circuit may be configured to cause a color temperature produced by the plurality of light-emitting devices to vary in response to the dimming control input over a range from about 3000 K to about 1800 K while maintaining a color rendering index (CRI) greater than about 80%. The control circuit and the plurality of light-emitting devices may be configured to maintain a CRI greater than about 90% for brightness levels between a maximum brightness level and about 5% of the maximum brightness level.

In some embodiments, the least one red light-emitting device, the at least one BSY light-emitting device having a first BSY output and the at least one BSY light-emitting device having a second BSY output with a greater yellow content than the first BSY output may be serially connected in a string of light-emitting devices coupled between first and second terminals. The control circuit may be configured to vary a color temperature produced by the string responsive to a variation in a total current passing between the first and second terminals.

In additional embodiments, the control circuit may be configured to provide a substantially fixed color temperature over a first range of brightness levels and to conform the color temperature to the Planckian locus over a second range of brightness levels. For example, the first range of brightness levels may be a range of brightness levels between a maximum brightness level and about 20% of the maximum brightness level.

In still further embodiments of the inventive subject matter, a lighting apparatus includes a plurality of light-emitting devices including light-emitting devices having at least three different chromaticities and a control circuit operatively coupled to the plurality of light-emitting devices and configured to cause a color temperature produced by the plurality of light-emitting devices to vary in response to a dimming control input over a range from about 5000 K to about 2000 K while maintaining a color rendering index (CRI) greater than about 80%. For example, the control circuit and the plurality of light-emitting devices may be configured to maintain a CRI greater than about 90% for brightness levels between a maximum brightness level and about 20% of the maximum brightness level.

In some embodiments, the plurality of light-emitting devices may include at least one BSY light-emitting device having a first BSY output, at least one BSY light-emitting device having a second BSY output with a greater yellow content than the first BSY output and at least one red light-emitting device. The plurality of light-emitting devices may include a string of serially-connected light-emitting devices coupled between first and second terminals and including a first set of light-emitting devices having a first chromaticity and a second set of light-emitting devices having a second chromaticity different from the first chromaticity. The control circuit may includes a control circuit operatively coupled to the string and configured to vary a color temperature produced by the string responsive to a variation in a total current passing between the first and second terminals. The string of serially-connected light-emitting devices may include at least one BSY light-emitting device having a first BSY output and at least one BSY light-emitting device having a second BSY output with a greater yellow content than the first BSY output.

In further embodiments, the control circuit may be configured to provide a substantially fixed color temperature over a first range of brightness levels and to conform the color temperature to the Planckian locus over a second range of brightness levels. The first range of brightness levels may be, for example, a range of brightness levels between a maximum brightness level and about 20% of the maximum brightness level.

In additional embodiments, a lighting apparatus includes a plurality of light-emitting devices comprising first and second sets of light-emitting devices having substantially overlapping output spectra and chromaticities falling within respective first and second different chromaticity ranges and a control circuit operatively coupled to the plurality of light-emitting devices and configured to differentially operate the first and second sets of light-emitting devices in response to a dimming control input. The first and second sets of light-emitting devices may include first and second sets of LEDs in a string of LEDs serially connected between first and second terminals. The control circuit may be configured to differentially vary current passing through the first and second sets of LEDs responsive to a total current passing between the first and second terminals. For example, the control circuit may include a bypass circuit configured to differentially bypass current around the first set of LEDs with respect to the second set of LEDs responsive to the total current.

BRIEF DESCRIPTION OF THE DRAWINGS

The accompanying drawings, which are included to provide a further understanding of the invention and are incorporated in and constitute a part of this application, illustrate certain embodiment(s) of the invention. In the drawings.

DETAILED DESCRIPTION OF EMBODIMENTS

Figure 1:
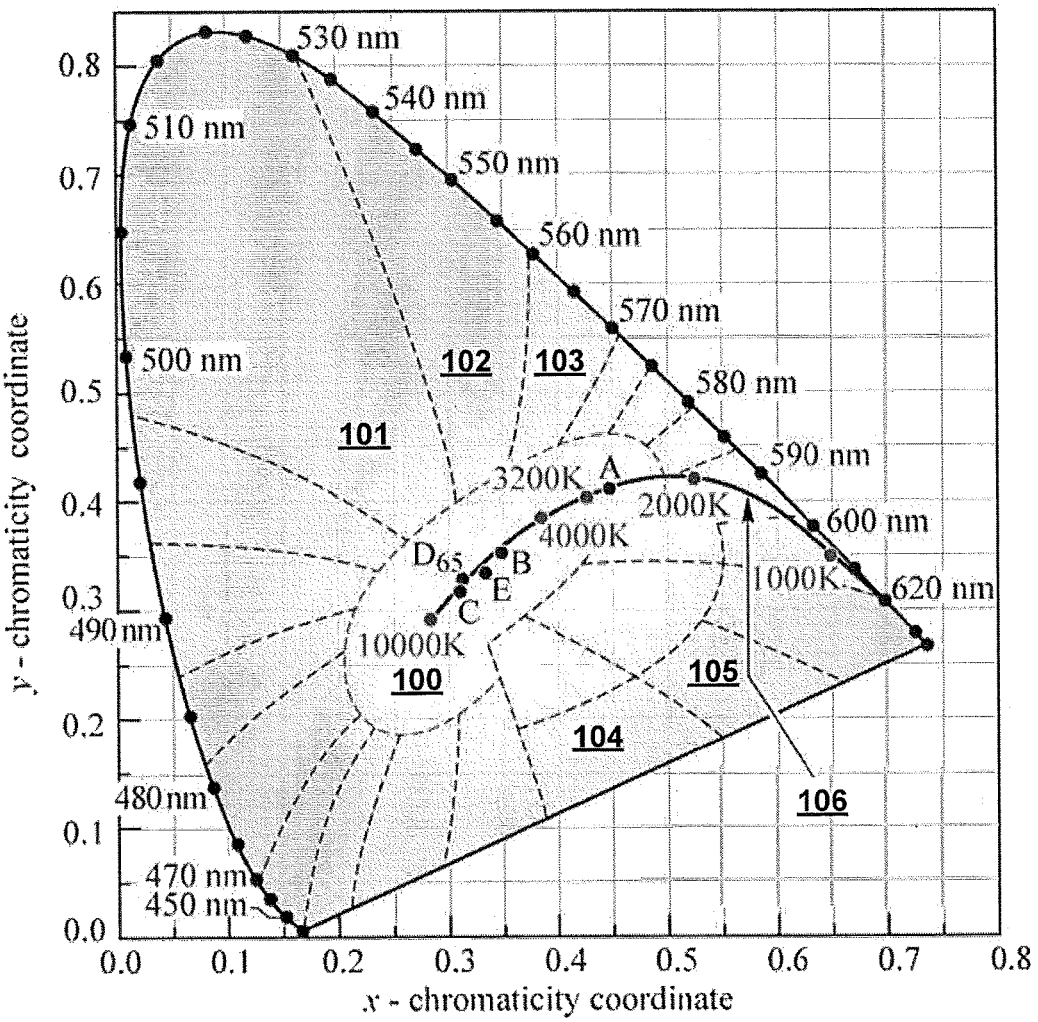
FIG. 1 is a chromaticity diagram illustrating a Planckian locus.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Embodiments of the present inventive subject matter now will be described more fully hereinafter with reference to the accompanying drawings, in which embodiments of the present inventive subject matter are shown. This present inventive subject matter may, however, be embodied in many different forms and should not be construed as limited to the embodiments set forth herein. Rather, these embodiments are provided so that this disclosure will be thorough and complete, and will fully convey the scope of the present inventive subject matter to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present inventive subject matter. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

The terminology used herein is for the purpose of describing particular embodiments only and is not intended to be limiting of the present inventive subject matter. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this present inventive subject matter belongs. It will be further understood that terms used herein should be interpreted as having a meaning that is consistent with their meaning in the context of this specification and the relevant art and will not be interpreted in an idealized or overly formal sense unless expressly so defined herein. The term "plurality" is used herein to refer to two or more of the referenced item.

The following description of some embodiments of the inventive subject matter refers to "light-emitting devices," which may include, but is not limited to, solid-state lighting devices, such as light emitting diode (LED) devices. As used herein, "LED" includes, but is not limited to, direct-emission devices that produce light when a voltage is applied across a PN junction thereof, as well as combinations of such direct-emission devices with luminescent materials, such as phosphors that emit visible-light radiation when excited by a source of radiation, such as a direct-emission device.

Embodiments of the present invention provide systems and methods for controlling solid state lighting devices and lighting apparatus incorporating such systems and/or methods. In some embodiments, the present invention can be utilized in connection with bypass circuits as described in co-pending and commonly assigned U.S. patent application Ser. No. 12/566,195 entitled "Solid State Lighting Apparatus with Controllable Bypass Circuits and Methods of Operating Thereof" , co-pending and commonly assigned U.S. patent application Ser. No. 12/704,730 entitled "Solid State Lighting Apparatus with Compensation Bypass Circuits and Methods of Operation Thereof" and co-pending and commonly assigned U.S. patent application Ser. No. 12/566,142 entitled "Solid State Lighting Apparatus with Configurable Shunts" , the disclosures of which are incorporated herein by reference.

Figure 2A:
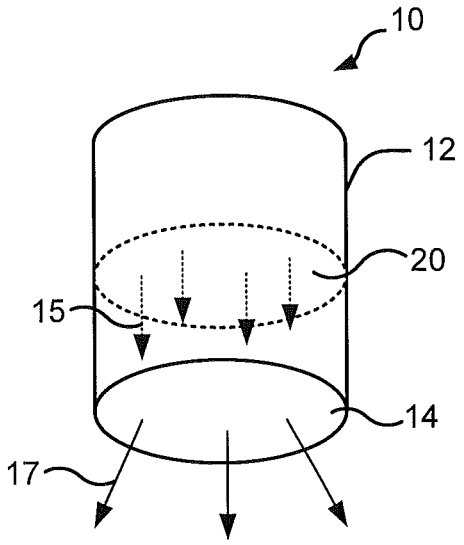
FIGS. 2A and 2B illustrate a solid state lighting apparatus in accordance with some embodiments of the present inventive subject matter.
Figure 2B:
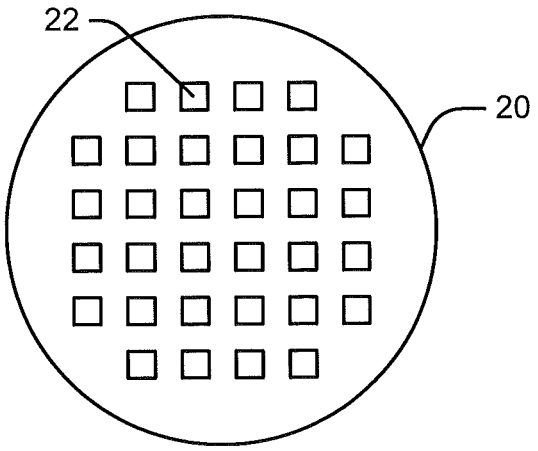

Referring to FIGS. 2A and 2B, a lighting apparatus 10 according to some embodiments is illustrated. The lighting apparatus 10 shown in FIGS. 2A and 2B is a "recessed downlight" or "can" lighting fixture that may be suitable for use in general illumination applications as a down light or spot light. However, it will be appreciated that a lighting apparatus according to some embodiments may have a different form factor. For example, a lighting apparatus according to some embodiments can have the shape of a conventional light bulb, a pan or tray light, an automotive headlamp, or any other suitable form.

The lighting apparatus 10 generally includes a can shaped outer housing 12 in which a lighting panel 20 is arranged. In the embodiments illustrated in FIGS. 2A and 2B, the lighting panel 20 has a generally circular shape so as to fit within an interior of the cylindrical housing 12. Light is generated by solid state lighting devices (LEDs) 22, which are mounted on the lighting panel 20, and which are arranged to emit light 15 towards a diffusing lens 14 mounted at the end of the housing 12. Diffused light 17 is emitted through the lens 14. In some embodiments, the lens 14 may not diffuse the emitted light 15, but may redirect and/or focus the emitted light 15 in a desired near-field or far-field pattern. The LEDs 22 may include LEDs of different chromaticities that may be selectively controlled to produce a desired intensity, correlated color temperature (CCT) and/or color rendering index (CRI) using various techniques discussed in detail below.

According to some embodiments of the inventive subject matter, a lighting apparatus may include a combination of at least two sets of light-emitting devices that have significantly overlapping spectral outputs but that have distinctly different chromaticities such that differential control of output intensity of the sets can produce a desired color temperature and/or other characteristic, such as a approximation of incandescent lamp behavior, in response to a dimming control input, such as a AC phase-cut signal, analog dimming signal and/or digital dimming signal. For example, in some embodiments, a lighting apparatus may include at least one red light-emitting device, at least one blue-shifted yellow (BSY) light-emitting device having a first BSY output and at least one BSY light-emitting device having a second BSY output with a greater yellow content than the first BSY output. These various light-emitting devices may be selectively controlled such that a color temperature produced by the light-emitting devices varies substantially in conformance with the Planckian locus in response to a dimming control input. In some embodiments, a lighting apparatus may include a string of serially-connected light-emitting diodes (LEDs) coupled between first and second terminals. The string may include a first set of LEDs having a first chromaticity, for example, a first set of BSY LEDs producing a first chromaticity, and a second set of LEDs having a second chromaticity different from the first chromaticity, for example, a second set of BSY LEDs having a second chromaticity that is more yellow then the first set of BSY LEDs. A control circuit may vary a color temperature produced by the string responsive to a variation in a total current passing between the first and second terminals, which may correspond to a dimming control input. According to further embodiments, such lighting apparatus may be configured to maintain a desired color rendering index (CRI) over a particular ranges of brightness levels.

In some embodiments, a lighting apparatus may include blue-shifted yellow (BSY) light emitting devices used in combination with other color emitters to produce light of a desired chromaticity, color temperature, color rendering index or other characteristics. Such BSY devices may include, for example, LED devices that include a combination of a blue excitation diode and a phosphor, as described in U.S. Pat. No. 7,213,940, issued May 8, 2007, and entitled "LIGHTING DEVICE AND LIGHTING METHOD," the disclosure of which is incorporated herein by reference. As described therein, a lighting device may include solid state light emitters (i.e., LED devices) which emit light having dominant wavelength in ranges of from 430 nm to 480 nm, and a group of phosphors which emit light having dominant wavelength in the range of from 555 nm to 585 nm. A combination of light by the first group of emitters, and light emitted by the group of phosphors produces a sub-mixture of light having x, y color coordinates within a BSY area on a 1931 CIE Chromaticity Diagram, generally illustrated as region 310 in the 1931 CIE Chromaticity Diagram shown in FIG. 3. Such non-white light may, when combined with light having a dominant wavelength from 600 nm to 630 nm, can be used to produce warm white light, as explained in U.S. Pat. No. 7,821,194, issued Oct. 26, 2010 and entitled "SOLID STATE LIGHTING DEVICES INCLUDING LIGHT MIXTURES," the disclosure of which is incorporate herein by reference.

Figure 3:
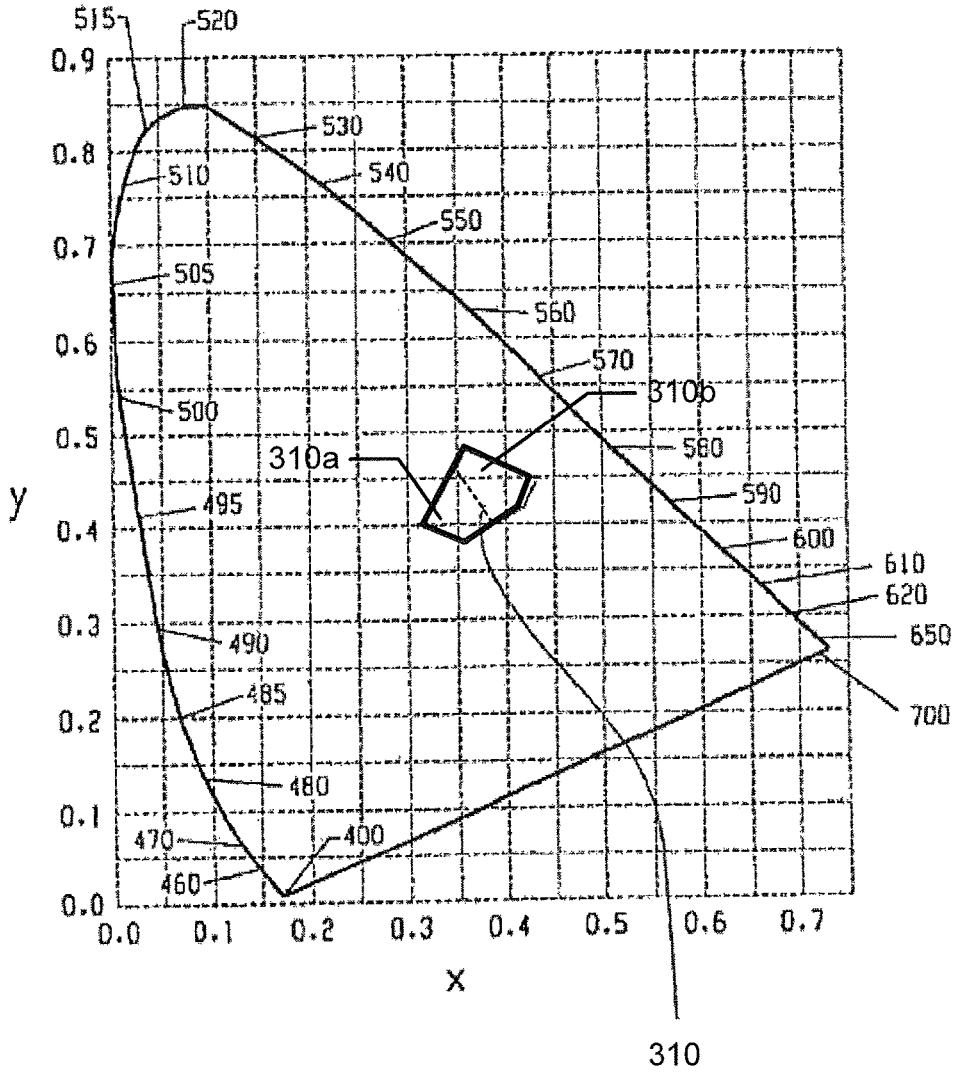
FIG. 3 is a chromaticity diagram illustrating blue-shifted yellow chromaticity regions.

As further shown in FIG. 3, in some embodiments of the inventive subject matter, a lighting apparatus may include two or more groups of such BSY light-emitting devices having respective different chromaticities within the BSY region 310. For example, a lighting apparatus may include a first set of BSY LEDs having chromaticities falling within a first subregion 310*a* of the BSY region 310, i.e., a "bluer" set of BSY LEDs, and a second set of BSY LEDs having chromaticities failing within a second subregion of 310*b* of the BSY region 310, i.e., a "yellower" set of BSY LEDs. These different sets of BSY LEDs may be selectively controlled to provide, for example, a desired color temperature performance in response to a dimming control input.

Figure 16:
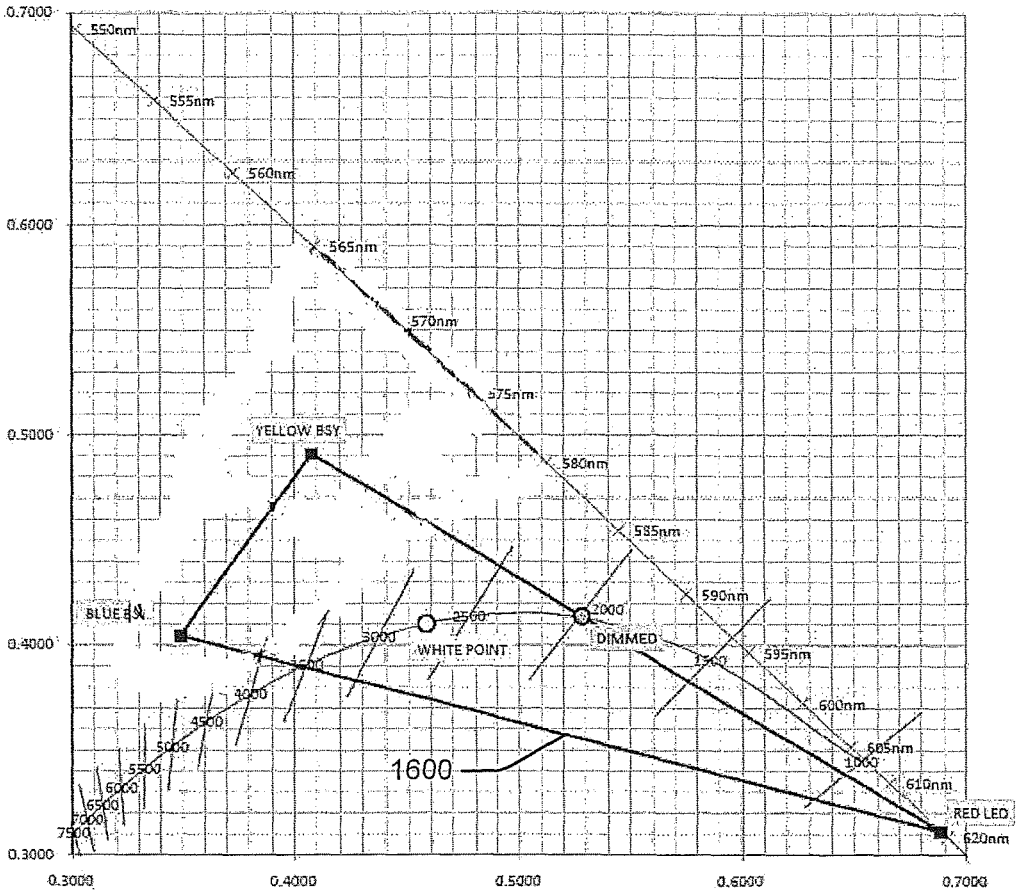
FIG. 16 is a chromaticity graph illustrating a range for LED selection according to some embodiments of the inventive subject matter.

FIG. 16 illustrates a region 1600 of a chromaticity chart from which the LEDs may be selected, indicating proximate regions for bluer and yellower BSY LEDS and red LEDs. Production LEDs generally exhibit variation in chromaticity, e.g., LEDs in a lot of BSY LEDs may vary in chromaticity. "Bins" may be defined for such BSY LEDS, e.g., respective bins may be assigned respective ranges of chromaticity values, and LEDs may be sorted according to where they fall with respect to these ranges. In some embodiments, bluer BSY LEDs may be selected from a first bin and yellower BSY LEDs may be selected from a second bin such that, for example, there is v' variation of 0.005 or greater between the first and second bins.

Figure 4:
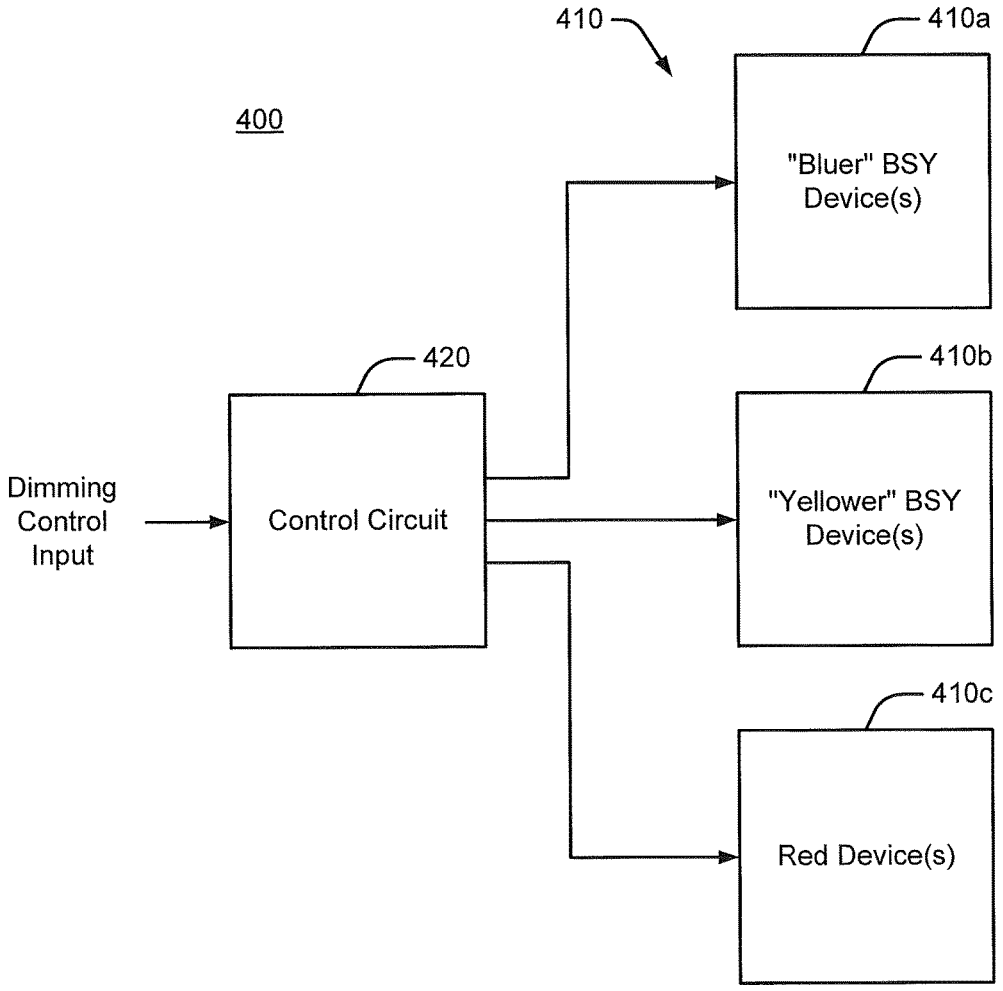
FIG. 4 is a schematic diagram illustrating a lighting apparatus according to some embodiments of the inventive subject matter.

FIG. 4 illustrates a lighting apparatus 400 according to some embodiments. The lighting apparatus 400 includes a plurality 410 of light emitting devices, including at least one BSY device 410*a* producing a bluer BSY output and at least one BSY device 410*b* producing a yellower BSY output. The apparatus 400 further includes at least one red light-emitting device 410*c*. A control circuit 420 is configured to vary the intensity of the bluer BSY light emitting device(s) 410*a* in relation to the intensity of the yellower BSY light emitting device(s) 410*a* in response to a dimming control input. For example, the control circuit 420 may be configured to vary the relative intensities such that light produced by the apparatus has a correlated color temperature (CCT) that substantially conforms to a Planckian locus of chromaticity. Such behavior can allow the lighting apparatus to approximate, for example, the color temperature characteristics of an incandescent lamp. In further embodiments, the control circuit 420 may be configured to provide other color temperature behavior. For example, the control circuit 420 may be configured to control the light-emitting devices 410 such that the light output of the apparatus maintains a relatively constant color temperature for a range of dimmer control inputs that correspond to a range of brightness levels, such as brightness levels between about 20% and about 100% of a maximum brightness level, and to approximate incandescent lamp behavior for a lower range of brightness levels.

According to some embodiments, conformance to the Planckian locus, for example, conformance within at least a ten step Macadam ellipse of the Planckian locus, may be achieved in an LED lighting apparatus that includes a plurality of serially-coupled BSY LEDs bypass circuitry that is configured to bypass selected ones of the BSY LEDs to produce a change in color temperature with intensity that approximates incandescent lighting and/or natural light.

Figure 5:
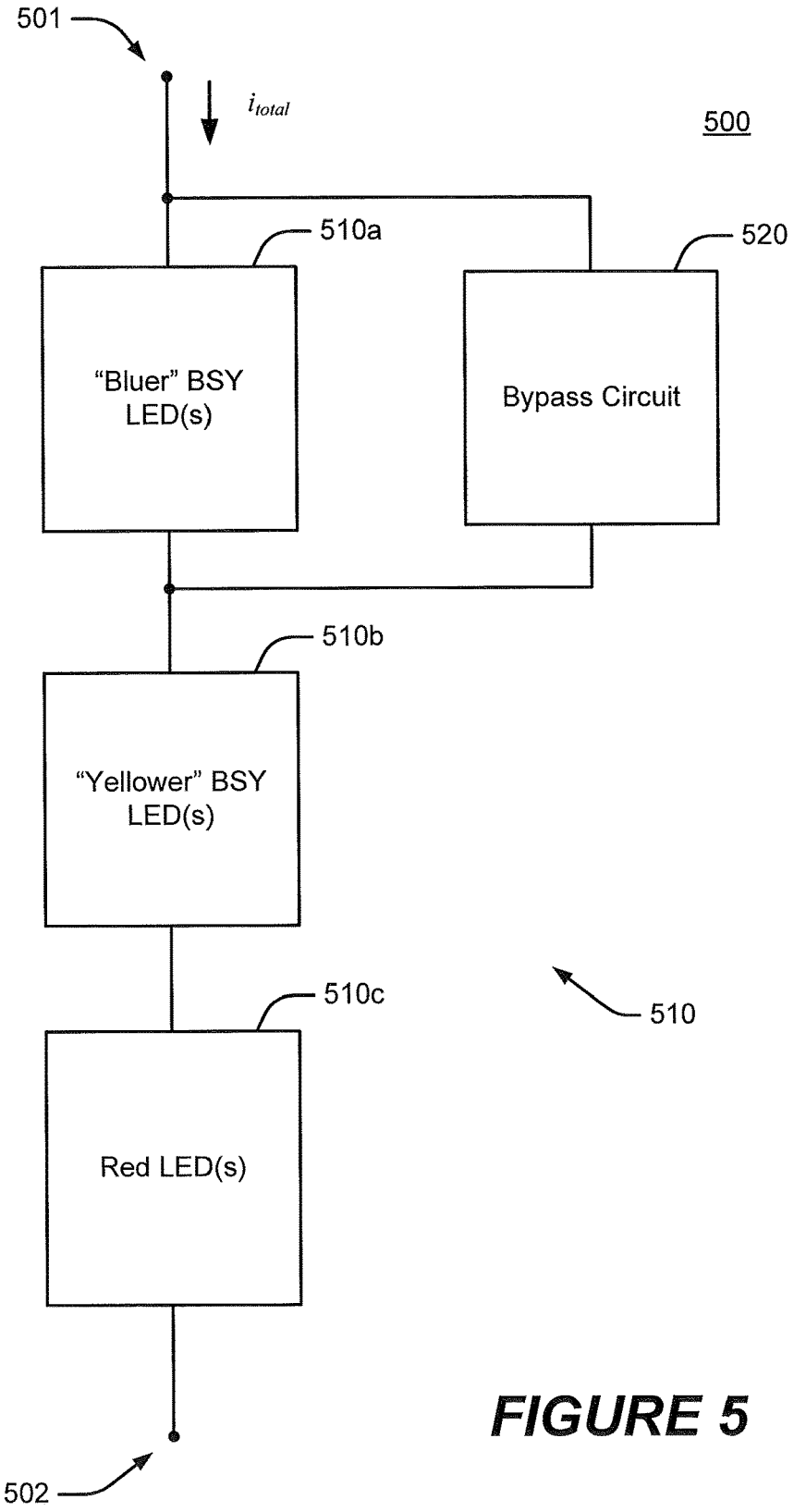
FIG. 5 is a schematic diagram illustrating a lighting apparatus including serially-connected LEDs and a selective bypass circuit according to some embodiments of the inventive subject matter.

For example, as shown in FIG. 5, a lighting apparatus 500 may include a string 510 with at least one bluer BSY LED 510*a* and at least one yellower BSY LED 510*b*, The string 510 may also include at least one red LED 510*c* coupled in series with the BSY LEDs 510*a*, 510*b* and/or one or more red LED's that provide light that combines with the BSY LEDs 510*a*, 520*b* may be provided in a separate string or other circuitry. A bypass circuit 520 may be configured to selectively bypass the at least one bluer BSY LED 510*a* responsive to dimming control input, such as a total current $i_{total}$ passing between first and second terminals 501, 502 of the string 510. The total current $i_{total}$ may, for example, be dependent on a signal such as a phase cut dimmer signal or other dimming control signal.

Figure 6:
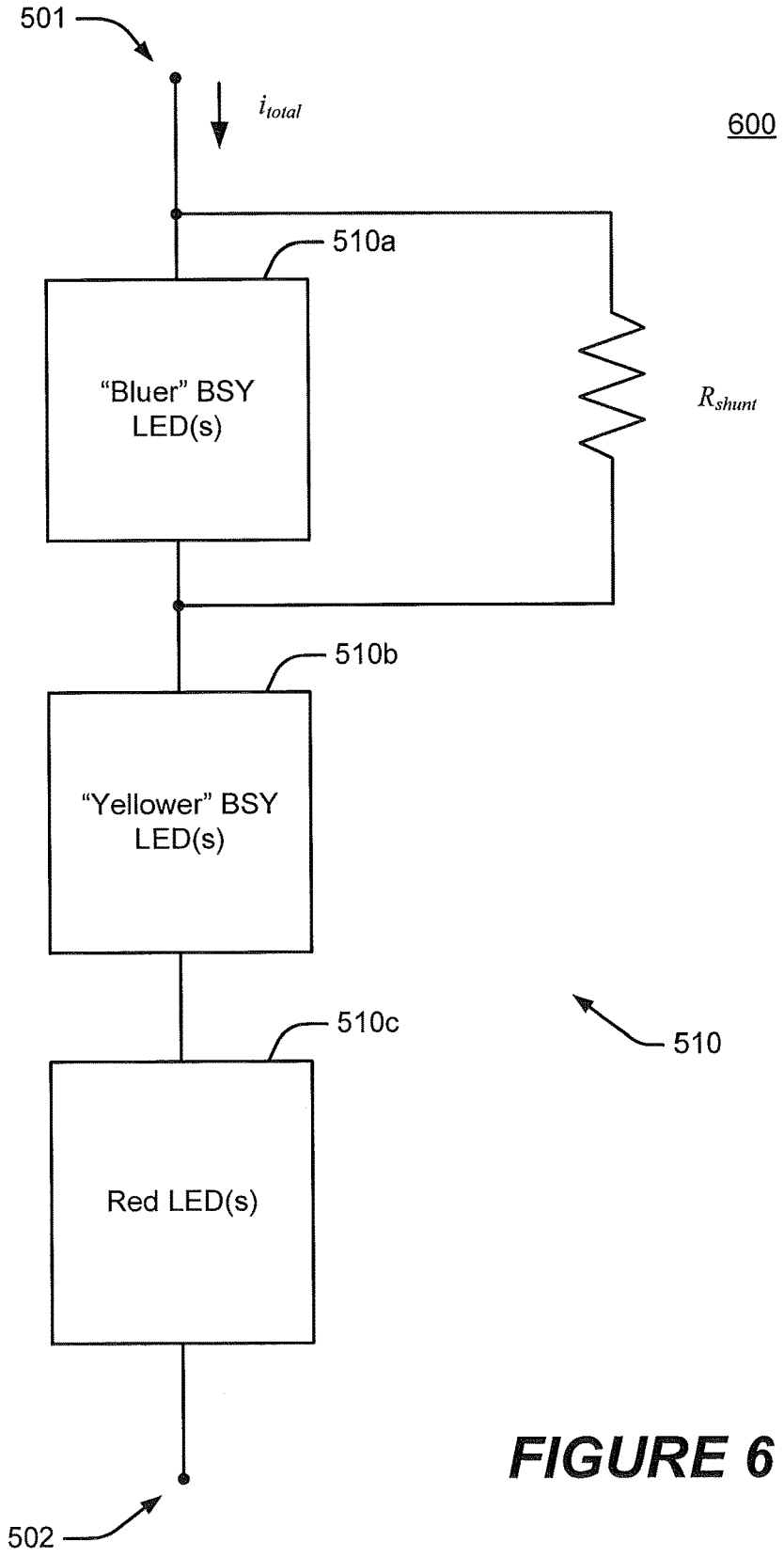
FIG. 6 is a schematic diagram illustrating a lighting apparatus with serially-connected LEDs and a resistive shunt according to further embodiments of the inventive subject matter.

As shown in FIG. 6, in a lighting apparatus 600 according to some embodiments, such a selective bypass circuit may take the form of a shunt resistor $R_{shunt}$. As the total current $i_{total}$ decreases, an increasing proportion of the total current $i_{total}$ passes through the shunt resistor $R_{shunt}$ in relation to the current passing through the at least one bluer BSY LED 510*a*, thus resulting in a relative decrease in contribution from the at least one bluer BSY LED 510. Accordingly, the color temperature of the light produced by the apparatus 500 decreases, shifting toward the yellow/red portions of the visible spectrum and producing a "warmer" light, much like the behavior of an incandescent lamp as it is dimmed.

Figure 7:
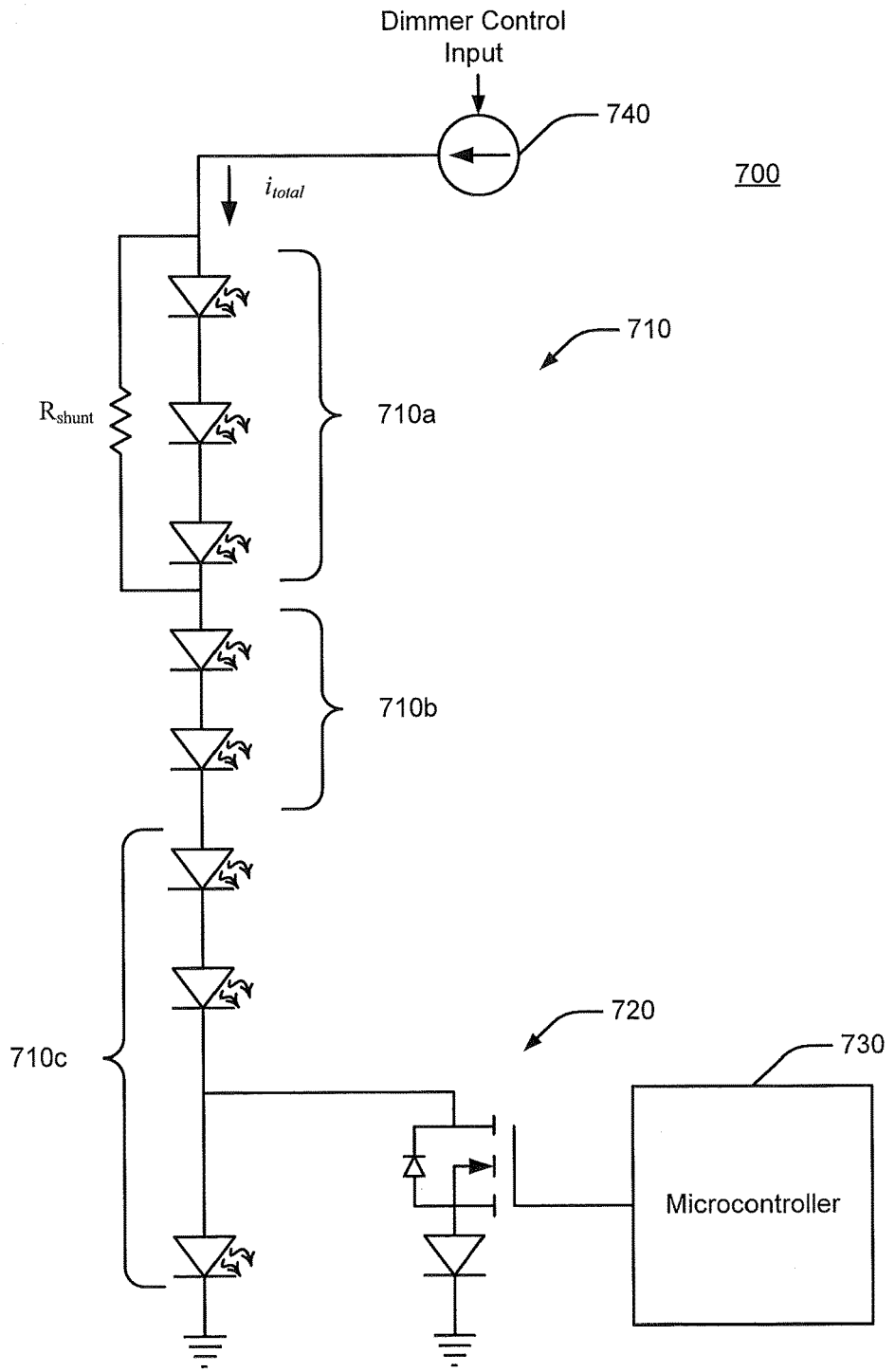
FIG. 7 is a schematic diagram illustrating a lighting apparatus configured to adjust a color temperature thereof in response to a dimmer control input according to some embodiments of the inventive subject matter.

FIG. 7 illustrates such an arrangement according to further embodiments of the inventive subject matter. A lighting apparatus 700 includes a string 710 of serially-coupled LEDs including bluer BSY LEDs 710*a*, yellower BSY LEDs 710*b* and red LEDs 710*c*. A switch 720 controlled by a microcontroller 730 may be used to perform temperature and other compensation to maintain, for example, a desired color point at, for example, a given brightness level commanded by a dimmer circuit 740. For example, the microcontroller 730 may be configured to receive a temperature signal from a temperature sensor and to responsively increase or reduce the relative intensity of light produced by the red LEDs 710*c* by selectively bypassing one or more of the red LEDs 710*c*. Compensation along such lines is described, for example, in U.S. patent application Ser. No. 12/704,730 , filed Feb. 12, 2010 and incorporated herein by reference in its entirety.

The apparatus 700 further includes a shunt resistor $R_{shunt}$ configured to bypass current around the bluer LEDs' 710*a* responsive to a total current $i_{total}$ passing through the string 710. Along lines discussed above, the shunt resistor $R_{shunt}$ may act to decrease the amount of illumination provided by the bluer LEDs 710*a* responsive to a decrease in the total current $i_{total}$, such that a color temperature produced by the apparatus 700 decreases with dimming of the apparatus 700. Through proper selection of the LEDs 710*a*, 710*b*, 710*c* and the shunt resistor $R_{shunt}$, the apparatus 700 may be constrained to substantially conform to the Planckian locus over a range of brightness levels of the apparatus 700. It will be appreciated that such performance may be achieved for a variety of different relative numbers of the LEDs 710*a*, 710*b*, 710*c* and/or the spectral characteristics thereof.

Figure 8:
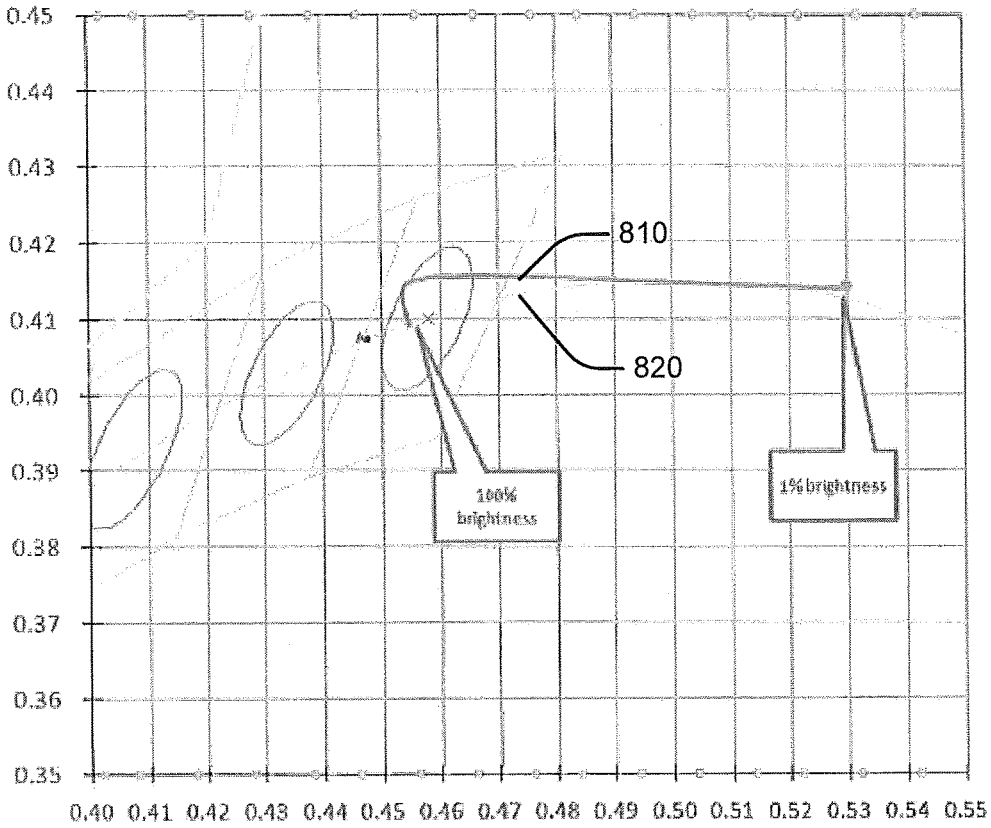
FIG. 8 is a graph illustrating color temperature control in a lighting apparatus according to some embodiments of the inventive subject matter.

FIG. 8 illustrates a chromaticity performance curve 810 for the apparatus 700 over a range of brightness levels between a maximum (100%) brightness and 1% of the maximum brightness. As can be seen from the figure, the curve 810 of the apparatus 700 substantially conforms to the Planckian locus 820 over the range of brightness levels. In particular, the curve 810 conforms within a 10 step Macadam ellipse over the brightness range.

Figure 9:
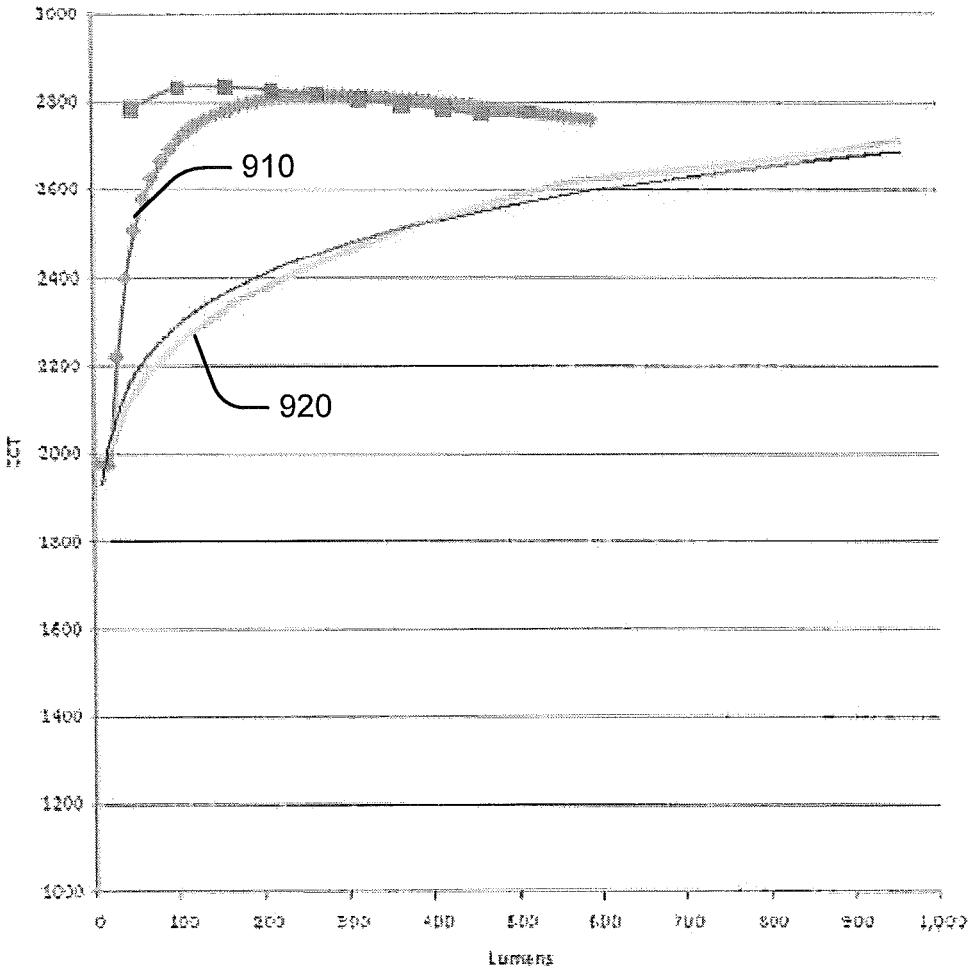
FIG. 9 is a graph illustrating examples of color temperature control in lighting apparatus according to further embodiments of the inventive subject matter.

FIG. 9 illustrates a curve 910 of simulated coordinated color temperature (CCT) performance with respect to luminous flux for the apparatus 700, in comparison to a curve 920 for a 60 W incandescent lamp.

Figure 10:
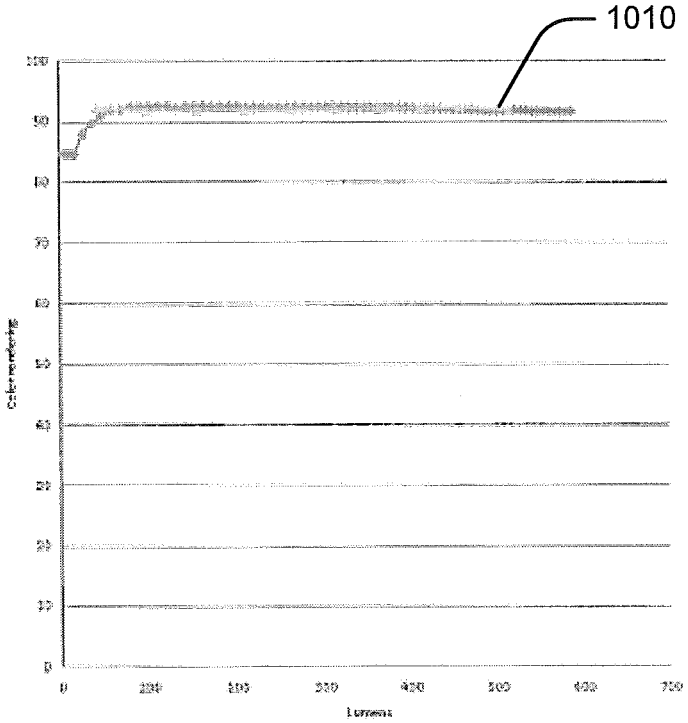
FIG. 10 is a schematic diagram illustrating a lighting apparatus including serially-connected LEDs with a pulse-width modulated bypass circuit according to some embodiments of the inventive subject matter.

FIG. 10 illustrates a simulated color rendering index (CRI) curve 1010 for the apparatus 700 over a range of luminance values. As shown, the curve 1010 maintains CRI values greater than 90% over a range of luminance values from a maximum luminance to approximately 20% of the maximum luminance.

According to further embodiments, bypass circuits other than shunt resistor circuits as described above with reference to FIGS. 6 and 7 may be used to achieve a desired color temperature characteristic over a range of dimming control inputs. For example, a lighting apparatus 1100 illustrated in FIG. 11 includes a string 510 of BSY and red LEDs 510*a*, 510*b*, 510*c* along the lines discussed above with reference to FIG. 4. The apparatus 1100 further includes a bypass circuit 1110 configured to variably bypass current around the set of bluer BSY LEDs 510*a* responsive to a dimming control input. As shown the bypass circuit 1110 includes a bypass switch 1112 (e.g., a field effect transistor (FET) or other solid state switching device) controlled by a control circuit 1110 responsive to the dimming control input. The control circuit 1114 may be configured, for example, to control a duty cycle of the switch 1112 to control an amount of current bypassed around the LED(s) 510*a*. For example, in response to a dimming control input to decrease brightness, the "on" period of the duty cycle of the switch 1112 may be increased such that a greater average current is diverted around the bluer BSY LED(s) 510*a* to reduce a color temperature of the light produced by the apparatus 1100 as it is dimmed. Switched bypass circuits that may be configured for use in such a manner are described in the aforementioned U.S. patent application Ser. No. 12/566,195 entitled "Solid State Lighting Apparatus with Controllable Bypass Circuits and Methods of Qperating Thereof", co-pending and commonly assigned U.S. patent application Ser. No. 12/704,730 entitled "Solid State Lighting Apparatus with Compensation Bypass Circuits and Methods of Operation Thereof".

Figure 12:
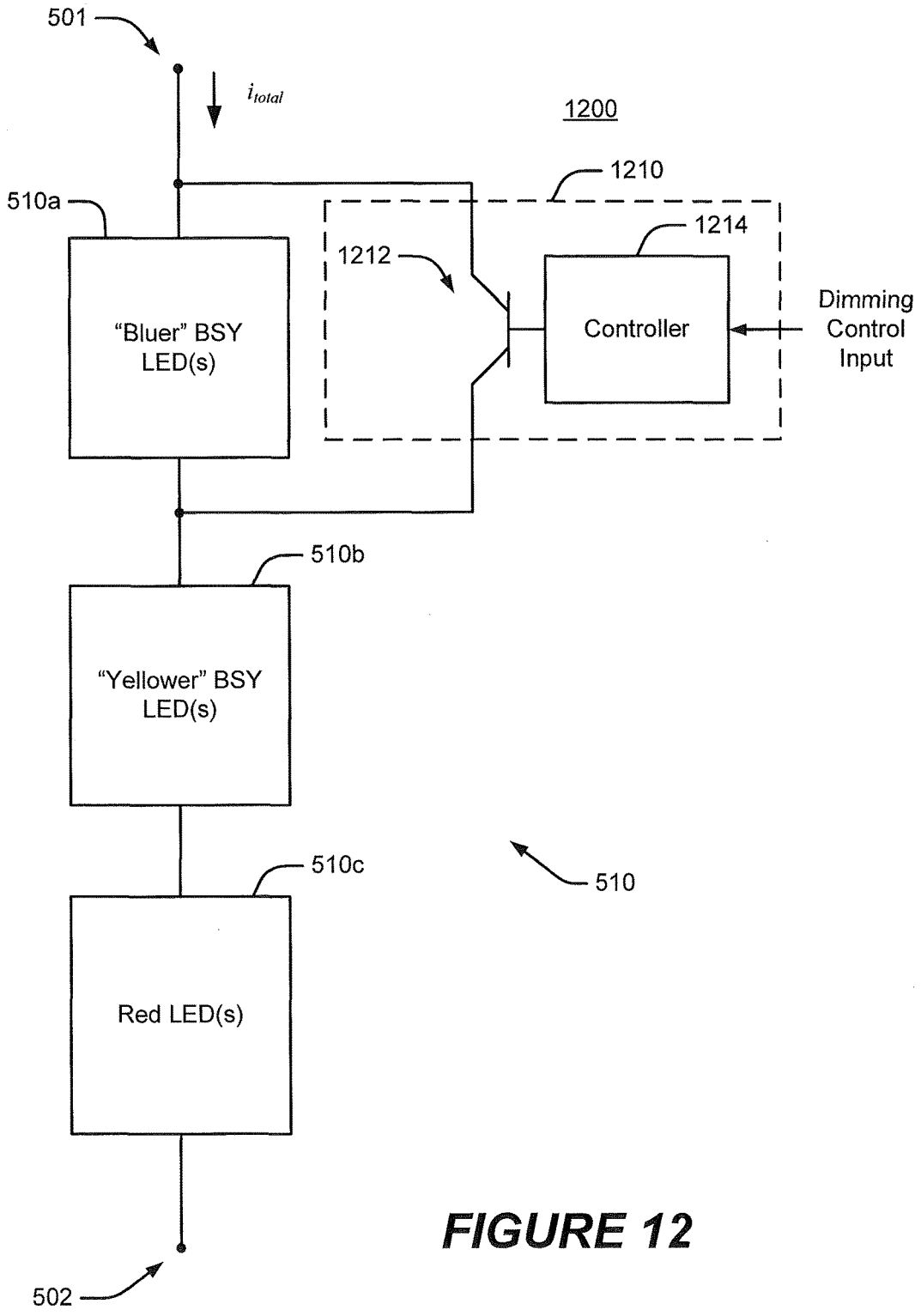
FIG. 12 is a graph illustrates color rendering performance over a range of brightness levels in a lighting apparatus according to some embodiments of the inventive subject matter.

FIG. 12 illustrates a lighting apparatus 1200 having an alternative variable resistance bypass circuit 1210. The bypass circuit 1210 includes a transistor 1212 (e.g., a bipolar junction transistor (BJT)) linearly controlled by a control circuit 1214 responsive to a dimming control input. The control circuit 1214 may be configured, for example, to control a resistance provided by the transistor 1212. For example, in response to a dimming control input to decrease brightness, the control circuit 1214 may decrease a resistance provided by the transistor 1212 such that a greater amount of current is diverted around the bluer BSY LED(s) 510*a* to reduce a color temperature of the light produced by the apparatus 1200. Linear bypass circuits that may be configured for use in such a manner are described in the aforementioned U.S. patent application Ser. No. 12/566,195 entitled "Solid State Lighting Apparatus with Controllable Bypass Circuits and Methods of Operating Thereof", co-pending and commonly assigned U.S. patent application Ser. No. 12/704,730 entitled "Solid State Lighting Apparatus with Compensation Bypass Circuits and Methods of Operation Thereof".

Figure 11:
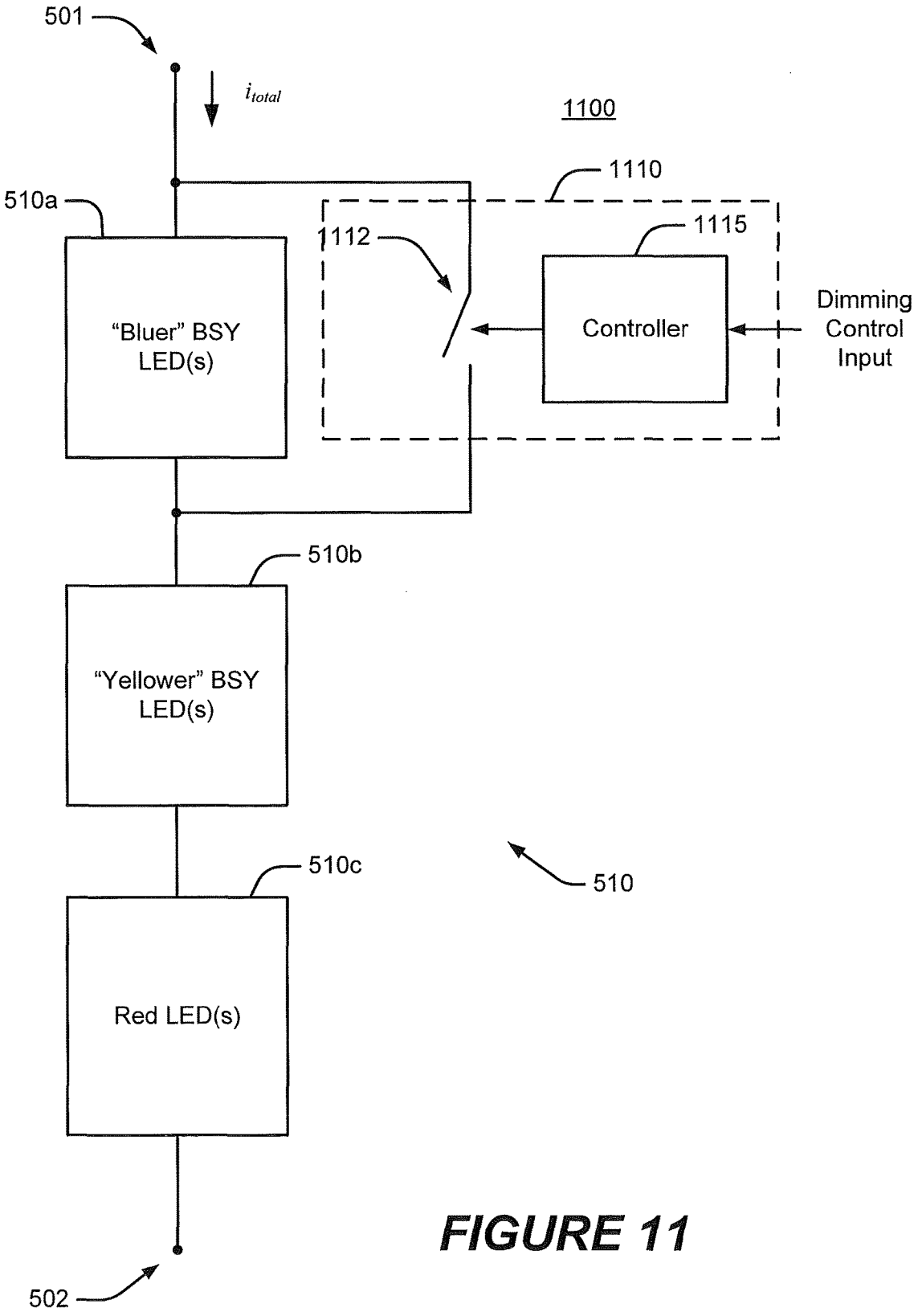
FIG. 11 is a schematic diagram illustrating a lighting apparatus including serially-connected LEDs with a linear bypass circuit according to some embodiments of the inventive subject matter.

According to further embodiments of the inventive subject matter, a lighting apparatus, such as the apparatus 1100, 1200 illustrated in FIGS. 11 and 12, may be configured to provide a color temperature behavior that approximates incandescent light over a first range of brightness levels and to provide a different color temperature behavior over a second range of brightness levels. For example, control circuits such as the control circuits 1110, 1210 may be configured to provide a substantially constant color temperature over an upper range of brightness levels, and to conform the color temperature produced by the apparatus 1100, 1200 to the Planckian locus at lower brightness levels, such that, for example, the apparatus 1100, 1200 approximates behavior of an incandescent lamp or natural light at these lower brightness levels. In this manner, the lighting apparatus may provide a substantially fixed color temperature at higher brightness levels for purposes such as task lighting, while providing more intimate mood lighting at lower brightness levels.

Figure 13:
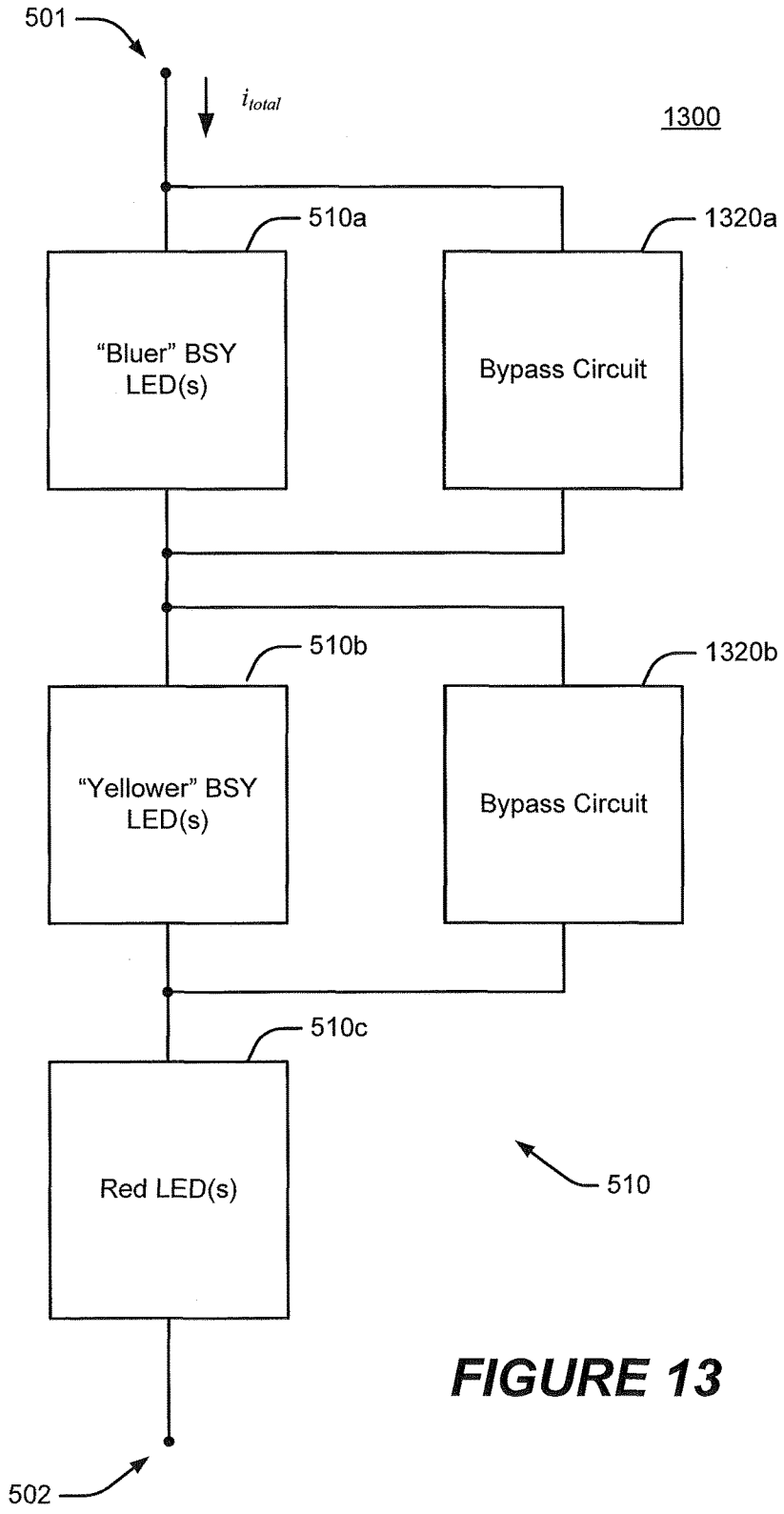
FIG. 13 is a schematic diagram illustrating a lighting apparatus including serially-connected LEDs and selective bypass circuitry according to some embodiments of the inventive subject matter.

Other configurations of bypass circuits may be used in additional embodiments. For example, as illustrated in FIG. 13, a lighting apparatus 1300 may include a string 510 of BSY and red LEDs 510*a*, 510*b*, 510*c* as described above with reference to FIG. 4, with first and second bypass circuits 1320*a*, 1320*b* configured to selectively bypass current around respective ones of the different sets of BSY LEDs 510*a*, 510*b*. The bypass circuits 1320*a*, 1320*b* may be configured, for example, to provide current bypass characteristics for the different sets of BSY LEDs 510*a*, 510*b* to support color temperature control along the lines discussed above. In further embodiments, bypass circuits may be used to bypass current around subsets of groups of LEDs such as the bluer and/or yellower sets of BSY LEDs 510*a*, 510*b* shown in FIG. 5. In certain embodiments, bypass circuits that are used for color temperature control for dimming purposes may also be used for other forms of compensation, such as temperature compensation and color point calibration.

Figure 14:
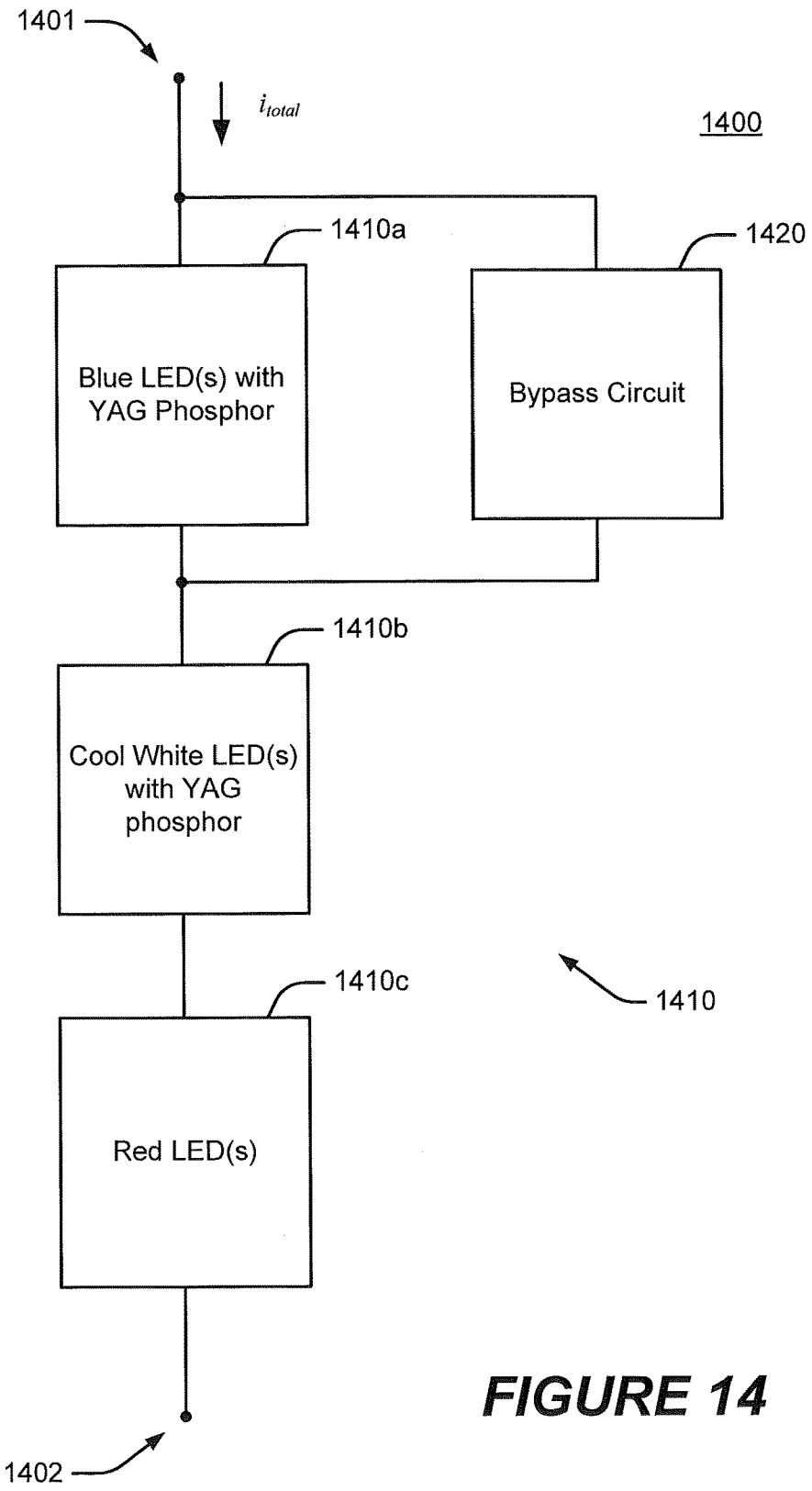
FIG. 14 is a schematic diagram illustrating a light apparatus including serially-connected LEDs and selective bypass circuitry according to further embodiments of the inventive subject matter.

According to further embodiments, other combinations of light emitting devices may be used for color temperature control in a manner similar to that described above. For example, as illustrated in FIG. 14, a lighting apparatus 1400 may include a string 1410 of LEDs serially coupled between first and second terminals 1401, 1402. The string 1410 may include one or more red LED's 1410*c*, along with one or more blue LEDs 1410*a* and one or more cool white LEDs 1410*b* that are used with an yttrium aluminum garnet (YAG) phosphor. The blue LED/YAG phosphor combination may be used to provide a bluer BSY component, while the cool while/YAG combination may provide a yellower BSY component. Similar to the apparatus described with reference to FIG. 4, a bypass circuit, such as a shunt resistor circuit or a controllable bypass circuit along the lines described with reference to FIGS. 11 and 12, may be used to selectively bypass current around the blue LED(s) 1410*a*, such that conformance with the Planckian locus may be achieved in response to a dimming control input.

Figure 15:
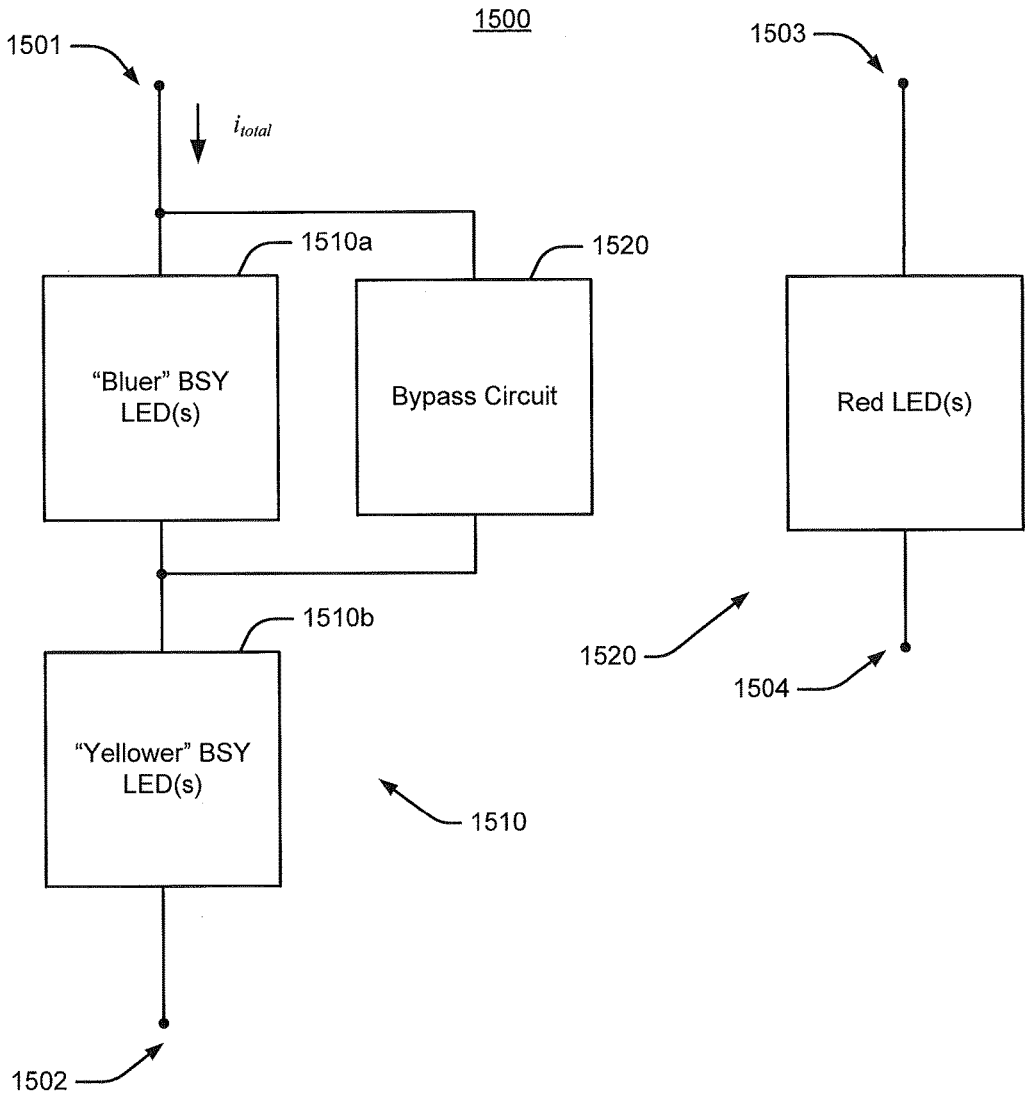
FIG. 15 is a schematic diagram illustrating a light apparatus including multiple LED strings with selective bypass circuitry according to some embodiments of the inventive subject matter.

According to further embodiments, multiple strings of LEDs may be used in manner similar to that described above with reference to FIG. 5. For example, in a lighting apparatus 1500 illustrated in FIG. 15, a first string 1510 may include bluer BSY LED's 1510*a* and yellower BSY LEDs 1510*b*, and a bypass circuit 1520 may be used to selectively bypass current around the bluer BSY LEDs 1510*a*, responsive to a total current $i_{total}$ passing through the string 1510 between first and second terminals 1501, 1502. A second string 1520 may include one or more red LEDs 1520*a* serially connected between third and fourth terminals 1503, 1504. It will be appreciated that the two strings 1510, 1520 may be connected in a parallel arrangement and/or may be powered by separate circuits. It will be further appreciated that the apparatus 1500 may include additional control circuitry, such as temperature compensation and/or color point calibration circuitry.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A lighting apparatus comprising:

a string of serially-connected light-emitting diodes (LEDs) coupled between first and second terminals and comprising a first set of LEDs providing first light output having a first chromaticity and a second set of LEDs providing second light output having a second chromaticity different from the first chromaticity; and a control circuit comprising a bypass circuit, coupled to the string, that bypasses at least one LED of at least one of the first and second sets of LEDs and varies a color temperature produced by the string by differentially varying respective currents passing through the first and second sets of LEDs of the string responsive to a variation in a total current passing between the first and second terminals, wherein the bypass circuit comprises a variable resistance circuit configured to continuously and differentially vary the respective currents passing through the first and second sets of LEDs, and wherein the control circuit is configured to provide the color temperature as a fixed color temperature over a first range of brightness levels and to conform the color temperature to the Planckian locus over a second range of brightness levels that is lower than the first range of brightness levels.

2. The apparatus of claim 1, wherein the bypass circuit is configured to differentially bypass current around the first set of LEDs with respect to the second set of LEDs responsive to the total current.

3. The apparatus of claim 2, wherein the bypass circuit is configured to differentially bypass current around the first set of LEDs with respect to the second set of LEDs responsive to the total current such that the color temperature decreases as the total current decreases.

4. The apparatus of claim 2, wherein the bypass circuit comprises at least one resistor coupled in parallel with at least one LED of the first set of LEDs.

5. The apparatus of claim 1, wherein the first set of LEDs comprises a first set of blue-shifted yellow (BSY) LEDs, wherein the second set of LEDs comprises a second set of BSY LEDs.

6. The apparatus of claim 5, wherein the string further comprises a set of red LEDs coupled in series with the first and second sets of BSY LEDs.

7. The apparatus of claim 1, wherein the control circuit is configured to conform the color temperature to within at least a 10 step MacAdam ellipse of the Planckian locus.

8. The apparatus of claim 1, wherein the control circuit is configured to conform the color temperature to within at least a 7 step MacAdam ellipse of the Planckian locus.

9. The apparatus of claim 1, wherein the control circuit is configured to conform the color temperature within at least a 5 step MacAdam ellipse of the Planckian locus.

10. The apparatus of claim 1, wherein the control circuit is configured to cause a color temperature produced by the string of LEDs to vary in response to the total current over a range from 3500K to 1800K while maintaining a color rendering index (CRI) greater than 80%.

11. The apparatus of claim 10, wherein the control circuit and the string of LEDs are configured to maintain a CRI greater than 90% for brightness levels between a maximum brightness level and 5% of the maximum brightness level.

12. The apparatus of claim 1, wherein the first range of brightness levels is between a maximum brightness level and 5% of the maximum brightness level.

13. A lighting apparatus comprising:

a plurality of light-emitting devices comprising at least one red light-emitting device, at least one BSY light-emitting device having a first BSY output and at least one BSY light-emitting device having a second BSY output with a greater yellow content than the first BSY output serially connected in a string of light-emitting devices coupled between first and second terminals; and a control circuit comprising a bypass circuit, coupled to the plurality of light-emitting devices, that bypasses at least one light-emitting device of the plurality of light-emitting devices to cause a color temperature produced by the plurality of light-emitting devices to vary in conformance with the Planckian locus in response to a variation in a total current passing between the first and second terminals, wherein the control circuit is configured to provide a fixed color temperature over a first range of brightness levels and to conform the color temperature to the Planckian locus over a second range of brightness levels that is lower than the first range of brightness levels.

14. The apparatus of claim 13, wherein the control circuit is configured to conform the color temperature to within at least a 10 step MacAdam ellipse of the Planckian locus.

15. The apparatus of claim 13, wherein the control circuit is configured to conform the color temperature to within at least a 7 step MacAdam ellipse of the Planckian locus.

16. The apparatus of claim 13, wherein the control circuit is configured to conform the color temperature to within at least a 5 step MacAdam ellipse of the Planckian locus.

17. The apparatus of claim 13, wherein the control circuit is configured to decrease a current through the at least one BSY light-emitting device having the first BSY output in comparison to a current through the at least one BSY light-emitting device having the second BSY output responsive to a dimming control input commanding a decrease in brightness.

18. The apparatus of claim 13, wherein the control circuit is configured to cause a color temperature produced by the plurality of light-emitting devices to vary in response to a dimming control input over a range from 3000K to 1800K while maintaining a color rendering index (CRI) greater than 80%.

19. The apparatus of claim 18, wherein the control circuit and the plurality of light-emitting devices are configured to maintain a CRI greater than 90% for brightness levels between a maximum brightness level and 5% of the maximum brightness level.

20. The apparatus of claim 13, wherein the first range of brightness levels is a range of brightness levels between a maximum brightness level and 20% of the maximum brightness level.

21. A lighting apparatus comprising:

a plurality of serially-coupled light-emitting devices comprising light-emitting devices having at least three different chromaticities and coupled between first and second terminals; and a control circuit comprising a bypass circuit, coupled to the plurality of serially-coupled light-emitting device, that bypasses at least one of the serially-coupled light-emitting devices and is configured to cause a color temperature produced by the plurality of light-emitting devices to vary in response to a variation of a total current between the first and second terminals over a range from 5000K to 2000K while maintaining a color rendering index (CRI) greater than 80%, wherein the control circuit is configured to provide a fixed color temperature over a first range of brightness levels and to conform the color temperature to the Planckian locus over a second range of brightness levels that is lower than the first range of brightness levels.

22. The apparatus of claim 21, wherein the control circuit and the plurality of light-emitting devices are configured to maintain a CRI greater than 90% for brightness levels between a maximum brightness level and 20% of the maximum brightness level.

23. The apparatus of claim 21, wherein the plurality of light-emitting devices comprises at least one BSY light-emitting device having a first BSY output, at least one BSY light-emitting device having a second BSY output with a greater yellow content than the first BSY output and at least one red light-emitting device.

24. The apparatus of claim 21, wherein the plurality of serially-coupled light-emitting devices comprises at least one BSY light-emitting device having a first BSY output and at least one BSY light-emitting device having a second BSY output with a greater yellow content than the first BSY output.

25. The apparatus of claim 21, wherein the first range of brightness levels is a range of brightness levels between a maximum brightness level and 20% of the maximum brightness level.

26. A lighting apparatus comprising:

a plurality of light-emitting devices comprising serially connected first and second sets of light-emitting devices having overlapping output spectra and chromaticities falling within respective first and second different chromaticity ranges; and a control circuit operatively coupled to the plurality of light-emitting devices and configured to differentially operate the first and second sets of light-emitting devices in response to a dimming control input, wherein the first and second sets of light-emitting devices are serially connected between first and second terminals, wherein the control circuit is configured to differentially vary current passing through the first and second sets of light-emitting devices responsive to a total current passing between the first and second terminals by controlling a resistance of a variable resistance circuit in a continuous manner responsive to the dimming control input, and wherein the control circuit is configured to provide a fixed color temperature of light emitted by the plurality of light-emitting devices over a first range of brightness levels and to conform a color temperature of light emitted by the plurality of light-emitting devices to the Planckian locus over a second range of brightness levels that is lower than the first range of brightness levels.

27. The apparatus of claim 26, wherein the control circuit comprises a bypass circuit configured to differentially bypass current around the first set of light emitting devices with respect to the second set of light emitting devices responsive to the total current.

28. The apparatus of claim 26, wherein the first set of light emitting devices comprises a first set of blue-shifted yellow (BSY) light emitting devices, wherein the second set of light emitting devices comprises a second set of BSY light emitting devices.

29. The apparatus of claim 1, wherein the control circuit is configured to vary the color temperature to approximate behavior of an incandescent lamp.

30. The apparatus of claim 1, wherein the variable resistance circuit is linearly controlled responsive to a dimming control input.

31. The apparatus of claim 13, wherein the bypass circuit comprises a variable resistance circuit that is linearly controlled responsive to a dimming control input and configured to differentially bypass current around the at least one light-emitting device of the plurality of light-emitting devices.

32. The apparatus of claim 21, wherein the bypass circuit comprises a variable resistance circuit that is linearly controlled responsive to a dimming control input and configured to differentially bypass current around the at least one of the serially-coupled light-emitting devices.

33. The apparatus of claim 27, wherein the bypass circuit comprises the variable resistance circuit configured to bypass the current around the first set of light-emitting devices, and wherein the variable resistance circuit is linearly controlled responsive to the dimming control input.

* * * * *